US008794617B2

(12) United States Patent
Tokuma

(10) Patent No.: US 8,794,617 B2
(45) Date of Patent: Aug. 5, 2014

(54) SHEET STACKING APPARATUS AND IMAGE FORMING APPARATUS

(75) Inventor: Naoto Tokuma, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 55 days.

(21) Appl. No.: 13/554,098

(22) Filed: Jul. 20, 2012

(65) Prior Publication Data

US 2013/0026695 A1 Jan. 31, 2013

(30) Foreign Application Priority Data

Jul. 29, 2011 (JP) ..... 2011-167587

(51) Int. Cl.
*B65H 37/04* (2006.01)

(52) U.S. Cl.
USPC ..... 270/58.12; 270/58.16; 270/58.17

(58) Field of Classification Search
USPC ..... 270/58.08, 58.11, 58.12, 58.13, 58.16, 270/58.17
See application file for complete search history.

(56) References Cited

U.S. PATENT DOCUMENTS

| | | | | |
|---|---|---|---|---|
| 5,622,359 | A * | 4/1997 | Kawano et al. | 270/58.12 |
| 6,698,744 | B2 * | 3/2004 | Yamada et al. | 270/58.12 |
| 6,871,851 | B2 | 3/2005 | Tamura et al. | |
| 7,419,150 | B2 * | 9/2008 | Kushida et al. | 270/58.07 |
| 7,866,650 | B2 * | 1/2011 | Nomura et al. | 270/58.12 |
| 8,006,971 | B2 * | 8/2011 | Iguchi et al. | 270/58.11 |
| 8,136,807 | B2 * | 3/2012 | Uchiyama et al. | 270/58.27 |
| 2002/0079642 | A1 | 6/2002 | Tamura et al. | |
| 2006/0279037 | A1 * | 12/2006 | Kushida et al. | 270/58.08 |
| 2009/0179373 | A1 * | 7/2009 | Awano et al. | 270/58.08 |
| 2009/0250861 | A1 * | 10/2009 | Kimura | 270/58.08 |
| 2012/0018943 | A1 * | 1/2012 | Shiraishi | 270/58.08 |

* cited by examiner

*Primary Examiner* — Patrick Mackey
(74) *Attorney, Agent, or Firm* — Fitzpatrick, Cella, Harper & Scinto

(57) ABSTRACT

A finisher is provided with a transport paddle and a control portion. The transport paddle freely moves to a first position where the transport paddle is on standby while protruding above a lower stack tray, a second position where the transport paddle sandwiches the sheet in between and, at the same time, is transported to abut the sheet against the abutment portion, and a third position where the transport paddle retracts in a finisher body 400. The control portion makes the transport paddle be on standby at the first position at least at the start of a job, moves the transport paddle between the first position and the second position for each discharge of the sheet by the bundle discharge roller pair, and moves the transport paddle to the third position after termination of the alignment processing for a last sheet of the job.

21 Claims, 20 Drawing Sheets

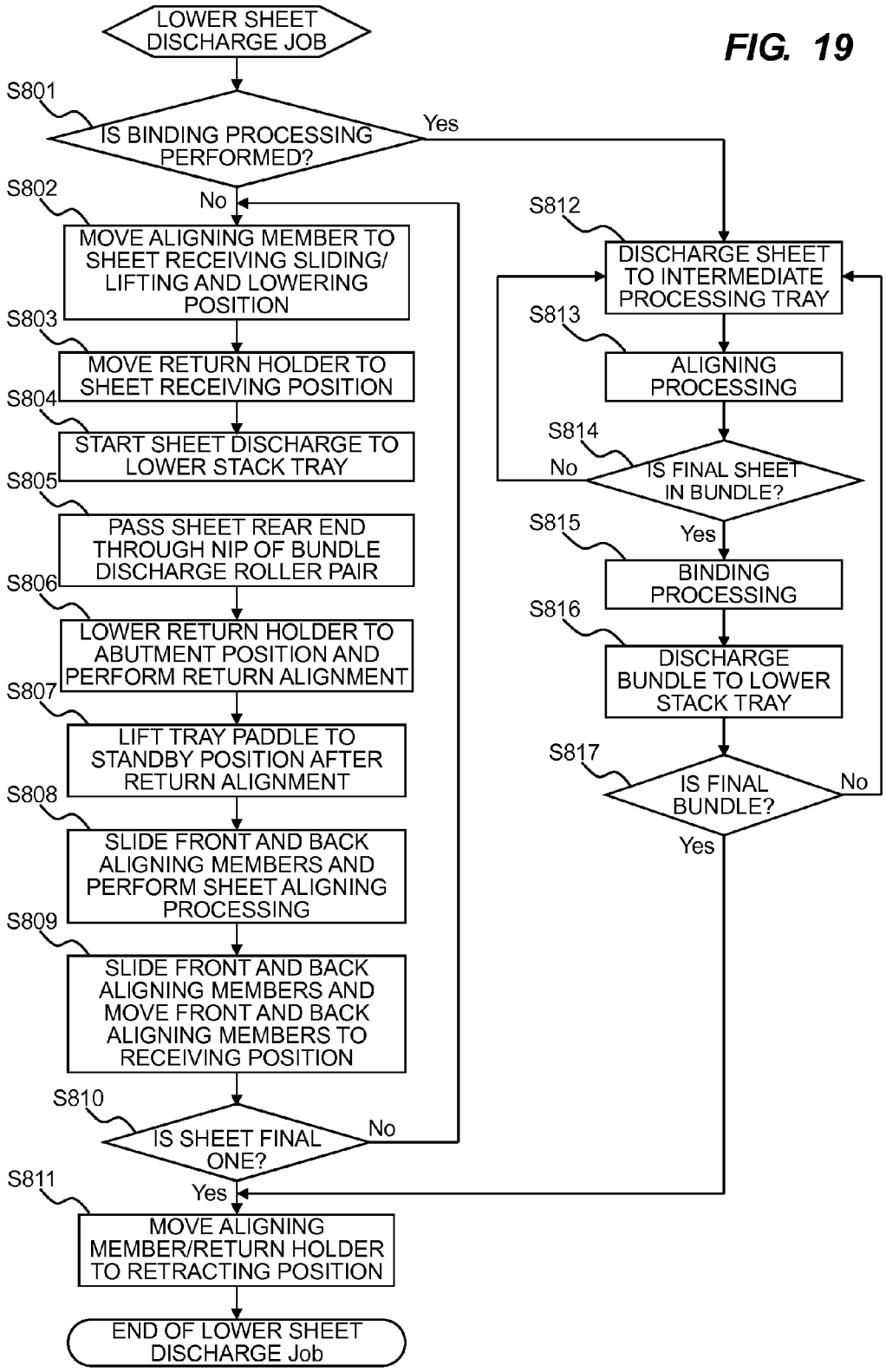
FIG. 19
LOWER SHEET DISCHARGE JOB
S801
IS BINDING PROCESSING PERFORMED?
Yes
No
S802
MOVE ALIGNING MEMBER TO SHEET RECEIVING SLIDING/ LIFTING AND LOWERING POSITION
S803
MOVE RETURN HOLDER TO SHEET RECEIVING POSITION
S804
START SHEET DISCHARGE TO LOWER STACK TRAY
S805
PASS SHEET REAR END THROUGH NIP OF BUNDLE DISCHARGE ROLLER PAIR
S806
LOWER RETURN HOLDER TO ABUTMENT POSITION AND PERFORM RETURN ALIGNMENT
S807
LIFT TRAY PADDLE TO STANDBY POSITION AFTER RETURN ALIGNMENT
S808
SLIDE FRONT AND BACK ALIGNING MEMBERS AND PERFORM SHEET ALIGNING PROCESSING
S809
SLIDE FRONT AND BACK ALIGNING MEMBERS AND MOVE FRONT AND BACK ALIGNING MEMBERS TO RECEIVING POSITION
S810
IS SHEET FINAL ONE?
No
Yes
S811
MOVE ALIGNING MEMBER/RETURN HOLDER TO RETRACTING POSITION
END OF LOWER SHEET DISCHARGE Job
S812
DISCHARGE SHEET TO INTERMEDIATE PROCESSING TRAY
S813
ALIGNING PROCESSING
S814
IS FINAL SHEET IN BUNDLE?
No
Yes
S815
BINDING PROCESSING
S816
DISCHARGE BUNDLE TO LOWER STACK TRAY
S817
IS FINAL BUNDLE?
No
Yes

SHEET STACKING APPARATUS AND IMAGE FORMING APPARATUS

BACKGROUND OF THE INVENTION

1. Field of the Invention

The present invention relates to a sheet stacking apparatus and an image forming apparatus, and relates particularly to a sheet stacking apparatus, which can align a sheet stacked on a stack tray, and an image forming apparatus provided with the sheet stacking apparatus.

2. Description of the Related Art

In the prior art, there has been known a sheet stacking apparatus which aligns a sheet discharged onto a stack tray, stacking a sheet, in a sheet discharge direction and a width direction perpendicular to the sheet discharge direction and enhances a sheet taking-out property of a sheet formed with an image (see, U.S. Patent Application Publication No. 2002/0079642 A1).

For example, a sheet stacking apparatus disclosed in U.S. Patent Application Publication No. 2002/0079642 A1 is provided with a discharge direction aligning portion which aligns a sheet in a sheet discharge direction and a width direction aligning portion which aligns the sheet in a width direction perpendicular to the sheet discharge direction. After the sheet is discharged onto the stack tray, the sheet is aligned in the discharge direction and the width direction. Specifically, the discharge direction aligning portion is provided with an abutment portion provided on an upstream side and a transport member which transports the sheet discharged onto the stack tray toward the abutment portion, and the sheet is abutted against the abutment portion by the transport member to align the sheet in the discharge direction. On the other hand, the width direction aligning portion is provided with a pair of aligning members, and the pair of aligning members is operated in the width direction to be brought into contact with end surfaces of a sheet to align the sheet in the width direction. Those operations are performed for each discharge of a sheet, whereby the sheet stacking apparatus can align all sheets in the discharge direction and the width direction.

In the sheet stacking apparatus disclosed in U.S. Patent Application Publication No. 2002/0079642 A1, the transport member is disposed below a sheet discharge portion which discharges a sheet onto the stack tray. Thus, after the discharged sheet is dropped on the stack tray by its own weight, the sheet is aligned in the discharge direction by the transport member. Consequently, when thin paper tending to be more frequently used recently is used, the self-weight drop time is long, and therefore, a timing of starting alignment operation is delayed. As a result, when the sheet stacking apparatus is used in an image forming apparatus with high productivity, there is a problem that the next sheet is discharged before completing the alignment operation and the alignment processing cannot be performed. Moreover, the posture of the thin paper during the self-weight dropping is unstable, and this easily prevents the alignment operation. As described above, the above sheet stacking apparatus has a problem that it cannot correspond to the image forming apparatus with high productivity and thin paper.

In contrast, it is considered that a transport member capable of lifting and lowering is disposed above the sheet discharge portion, and the transport member is lowered for each discharge of a sheet to drop the sheet forcibly, whereby sheet dropping time can be reduced, and, at the same time, the dropping posture can be stabilized. However, when the transport member is disposed above the sheet discharge portion, a user may touch the transport member when the user takes an aligned sheet, for example. When the user touches the transport member, the transport member may be damaged, and thus it is not preferable.

Thus, this invention provides a sheet stacking apparatus, which does not lower a sheet taking-out property of a sheet discharged onto a stack tray and can correspond to thin paper and an image forming portion with high productivity, and an image forming apparatus provided with the sheet stacking apparatus.

SUMMARY OF THE INVENTION

A sheet stacking apparatus configured to align a sheet conveyed from an image forming apparatus according to the present invention is provided with a discharge portion which discharges a sheet, a stacking portion on which the sheet discharged from the discharge portion is stacked, an abutment portion against which an upstream end in a discharge direction of the sheet discharged on the stacking portion is abutted, a transport member, provided above the discharge portion, which moves to a first position where the transport member is on standby while protruding above the stacking portion from an apparatus body, a second position where the transport member transports the sheet discharged on the stacking portion to abut against the abutment portion, and a third position where the transport member retracts in the apparatus body, and a control portion which controls movement of the transport member so that the transport member is on standby at the first position at the start of an image forming job, so that the transport member moves between the first position and the second position for each discharge of the sheet by the discharge portion, and so that the transport member moves to the third position after termination of the alignment processing for a last sheet of the image forming job.

The present invention can provide a sheet stacking apparatus, which does not lower a sheet taking-out property of a sheet discharged onto a stack tray and can correspond to thin paper and an image forming portion with high productivity, and an image forming apparatus provided with the sheet stacking apparatus.

Further features of the present invention will become apparent from the following description of exemplary embodiments with reference to the attached drawings.

BRIEF DESCRIPTION OF THE DRAWINGS

FIG. 19 is a flow chart illustrating an alignment processing of the sheet discharged onto the lower stack tray.

DESCRIPTION OF THE EMBODIMENTS

Hereinafter, an image forming apparatus according to embodiments of the present invention will be described with reference to the drawings. The image forming apparatus according to the embodiments of the present invention is provided with a sheet stacking apparatus, which can align a sheet, discharged to a stacking portion, in a discharge direction, such as a copier, a printer, a facsimile, and a multifunction machine thereof. In the following embodiments, a monochrome/color copier (hereinafter referred to as a "copier") 1000 is used as the image forming apparatus.

First Embodiment

Figure 1:
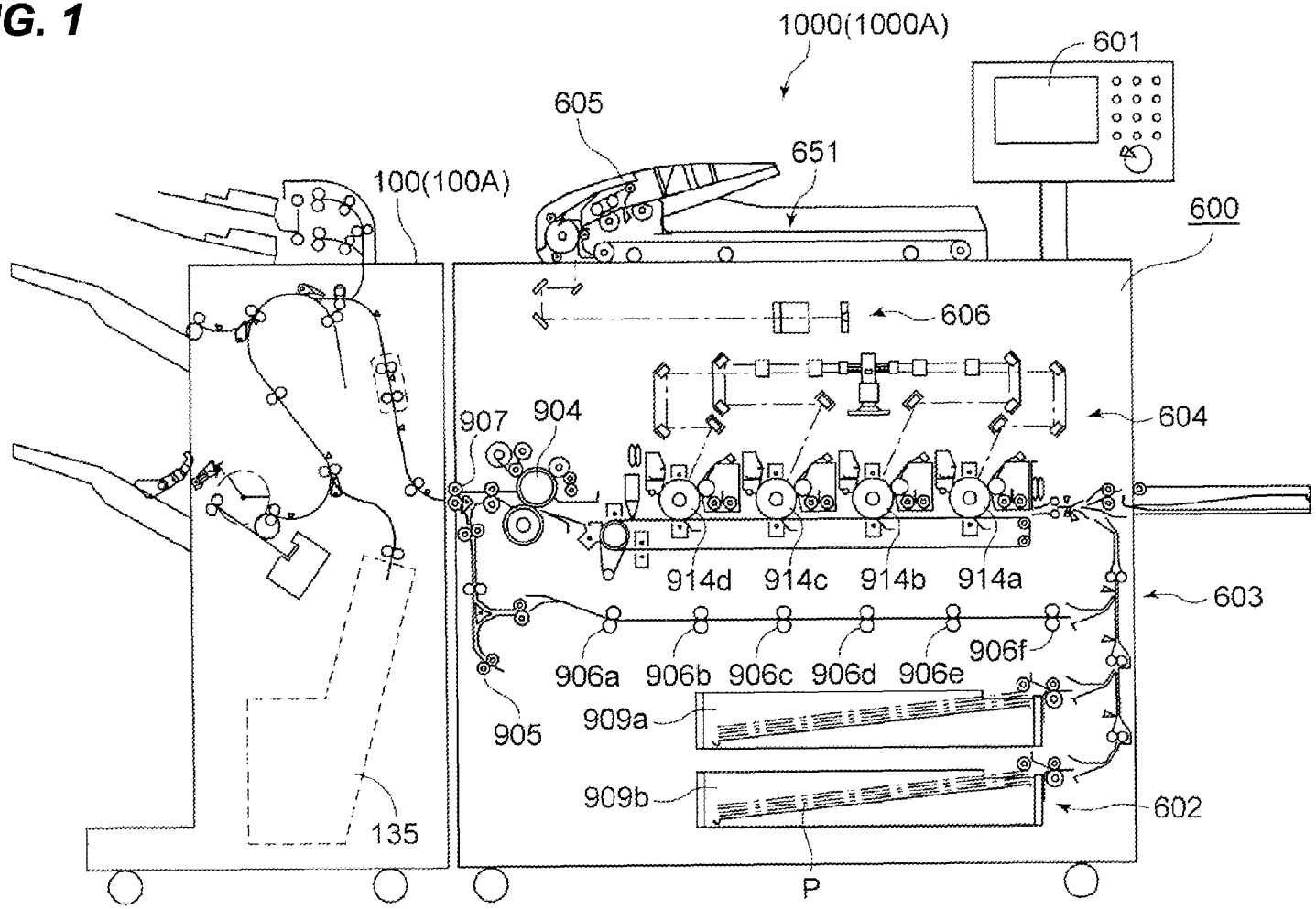
FIG. 1 is a cross-sectional view schematically illustrating a copier according to an embodiment of the present invention.
Figure 2:
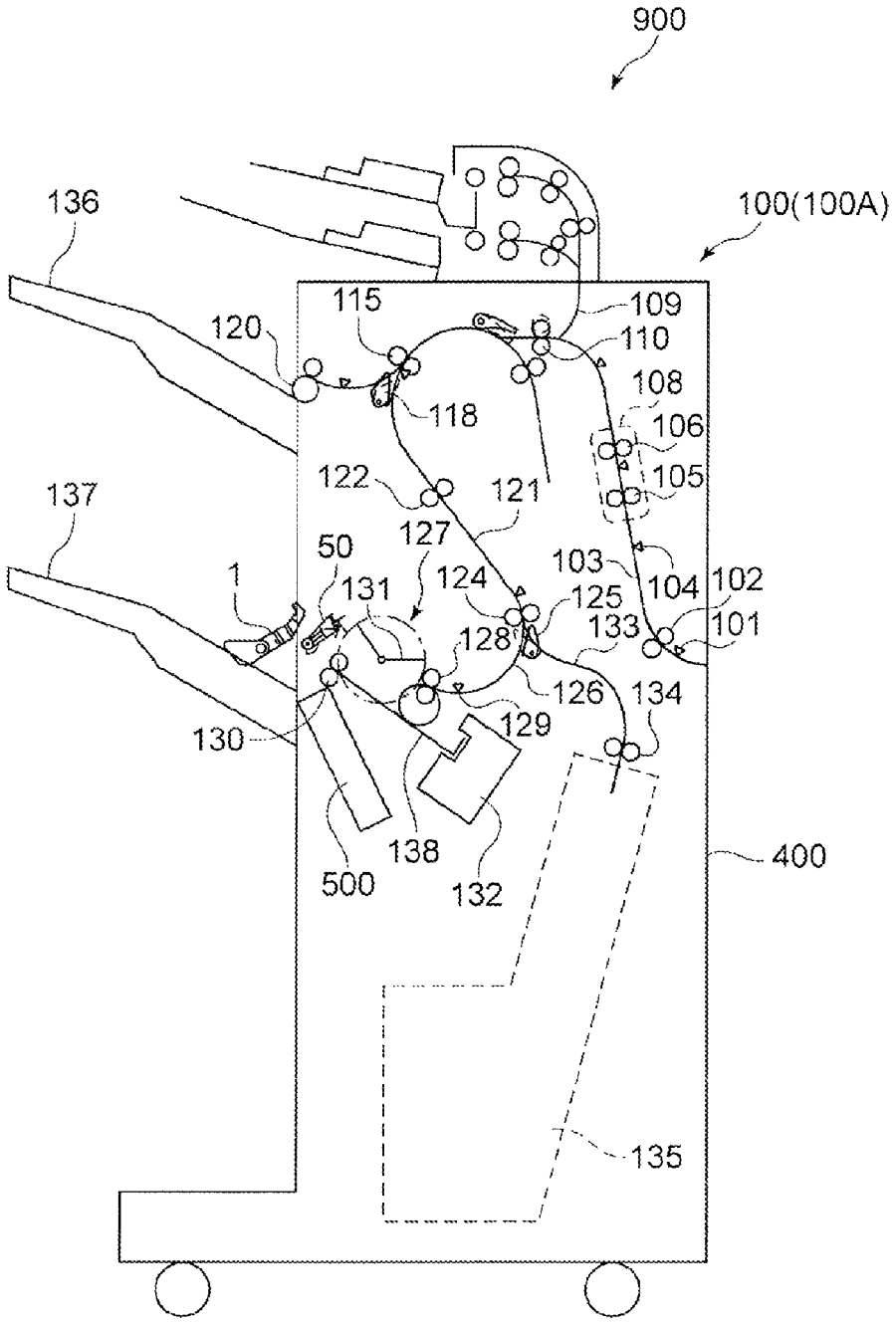
FIG. 2 is a cross-sectional view schematically illustrating a finisher according to the present embodiment.

The copier 1000 according to a first embodiment of the present invention will be described with reference to FIGS. 1 to 19. First of all, an overall configuration of the copier 1000 according to the first embodiment will be described in accordance with movement of a sheet P with reference to FIGS. 1 and 2. FIG. 1 is a cross-sectional view schematically illustrating the copier 1000 according to this embodiment of the present invention. FIG. 2 is a cross-sectional view schematically illustrating a finisher 100 according to this embodiment.

As illustrated in FIG. 1, the copier 1000 is provided with a copier body 600 which forms an image on the sheet P and the finisher 100 as a sheet stacking apparatus. The finisher 100 according to this embodiment is configured to be attachable to and detachable from the copier body 600 and can be used as an option for the copier body 600 which can be used alone.

In this embodiment, although described using the attachable and detachable finisher 100, the finisher 100 and the copier body 600 may be integral with each other. In the following description, a position where a user faces an operating portion 601 for performing various input/setting operations with respect to the copier 1000 is referred to as a "front side" of the copier 1000, and the back side of the copier 1000 is referred to as a "back side". Namely, FIG. 1 illustrates an internal configuration of the copier 1000 as viewed from the front side, and the finisher 100 is connected to a side portion of the copier body 600.

The copier body 600 is provided with a sheet storage portion 602, a sheet feeding portion 603 which feeds the sheet P stored in the sheet storage portion 602, and an image forming portion 604 which forms an image on the sheet P fed by the sheet feeding portion 603. The copier body 600 is further provided with a document feeding device 605 which can feed a document and an image reader which reads information of a document fed from the document feeding device 605.

The sheet storage portion 602 has cassettes 909*a* and 909*b* storing the sheets P, and the sheets P stored in the cassettes 909*a* and 909*b* are fed to the image forming portion 604 in predetermined timing by the sheet feeding portion 603. The image forming portion 604 has photosensitive drums 914*a* to 914*d* on which toner images of the respective colors of yellow, magenta, cyan, and black are formed and transfers the toner images of the respective colors formed on the photosensitive drums 914*a* to 914*d* to the sheet P. According to this constitution, an unfixed toner image is formed on the sheet P. Thereafter, the unfixed toner image is fixed by a fixer 904, and the sheet P is discharged to the finisher 100 by a discharge roller 907.

In double-sided printing, the sheet P is reversed by a reverse roller 905, and then the reversed sheet P is conveyed to the image forming portion 604 again by conveying rollers 906*a* to 906*f* provided in a reverse conveyance path, and the above operation is repeated. When document information as image information is formed on the sheet P, a document is fed from the document feeding device 605, and the toner image of the image information read by an image reader 606 is formed on the photosensitive drums 914*a* to 914*d* to be transferred to the sheet P and then to be fixed.

The finisher 100 is connected to the downstream side of the copier body 600, introduces a plurality of sheets P fed from the copier body 600, and can perform saddle processing and the like online. The finisher 100 is provided with an inserter 900 which can insert the sheet P into a conveyance path 109 in the finisher 100, and the inserter 900 is provided in an upper portion of a finisher body 400 as an apparatus body. The inserter 900 is used for inserting an insert sheet above a front page of a sheet bundle, under a final page, or between sheets on which an image is formed in the copier body 600.

As illustrated in FIG. 2, the sheet fed from the copier body 600 is first delivered to an entrance roller pair 102 of the finisher 100, and, at the same time, the timing of delivering the sheet P is detected by an entrance sensor 101. An end position of the sheet P conveyed by the entrance roller pair 102 is detected by a lateral registration detection sensor 104 while the sheet P passes through a conveyance path 103. The lateral registration detection sensor 104 detects how much lateral registration error X of the sheet P occurs with respect to a center (middle) position.

When the lateral registration error X is detected by the lateral registration detection sensor 104, a shift unit 108 is moved by a predetermined amount in the front-back direction in the middle of conveyance of the sheet P to shift roller pairs 105 and 106, whereby shift operation (also referred to as "lateral registration detection processing") of the sheet P is performed. A description of the lateral registration detection processing by the shift unit 108 is omitted here.

When the lateral registration detection processing by the shift unit 108 is completed, the sheet P is conveyed by a conveying roller pair 110, and the sheet P conveyed by the conveying roller pair 110 is further conveyed downstream by a buffer roller pair 115. Here, when the sheet P is discharged onto an upper stack tray 136, an upper path switching member 118 is moved to a position shown by a dashed line in FIG. 2 by a driving portion (not shown) which is a solenoid and the like. According to this constitution, the sheet P is guided to an upper path conveyance path 117 and discharged onto the upper stack tray 136 by an upper discharge roller pair 120.

Meanwhile, when the sheet P is not discharged onto the upper stack tray 136, the upper path switching member 118 moves to a position shown by a solid line in FIG. 2. Consequently, the sheet P is guided to a bundle conveyance path 121 and passes through the inside of the bundle conveyance path 121 by a buffer roller pair 122 and a bundle conveying roller pair 124.

Next, when a saddle stitching processing (saddle processing) is applied to the sheet P, a saddle path switching member 125 is moved to a position shown by a dashed line in FIG. 2 by a driving portion (not shown) which is a solenoid and the like. According to this constitution, the sheet P is conveyed to a saddle path 133, and the sheet P conveyed to the saddle path 133 is guided to a saddle unit 135 by a saddle entrance roller pair 134 and subjected to the saddle stitching processing (saddle processing). A description of the saddle stitching processing is omitted here.

Meanwhile, when the saddle stitching processing (saddle processing) is not performed, the saddle path switching member 125 is moved to a position shown by a solid line in FIG. 2. According to this constitution, the sheet P is conveyed to the bundle conveying roller pair 124 and sequentially conveyed onto a processing tray 138 as a processing stacking portion of a staple portion 127. The sheet P conveyed onto the processing tray 138 is aligned in the sheet discharge direction and the width direction and then subjected to binding process by the stapler 132. The sheet processing in the staple portion 127 will be described in detail later.

The sheet subjected to predetermined sheet processing in the staple portion 127 is discharged onto a lower stack tray 137 as a stacking portion as a discharge portion by a bundle discharge roller pair 130. Meanwhile, when predetermined sheet processing is not applied to the sheet P in the staple portion 127, the sheet P is delivered from a lower discharge roller pair 128 to the bundle discharge roller pair 130 and discharged onto the lower stack tray 137. The sheet P discharged onto the lower stack tray 137 is then aligned in the sheet width direction and the discharge direction on the lower stack tray 137 by a width direction aligning portion 200 and a discharge direction aligning portion 300 to be described later. The alignment processing in the width direction by the width direction aligning portion 200 and the alignment processing in the sheet discharge direction by the discharge direction aligning portion 300 will be described in detail later.

Figure 3:
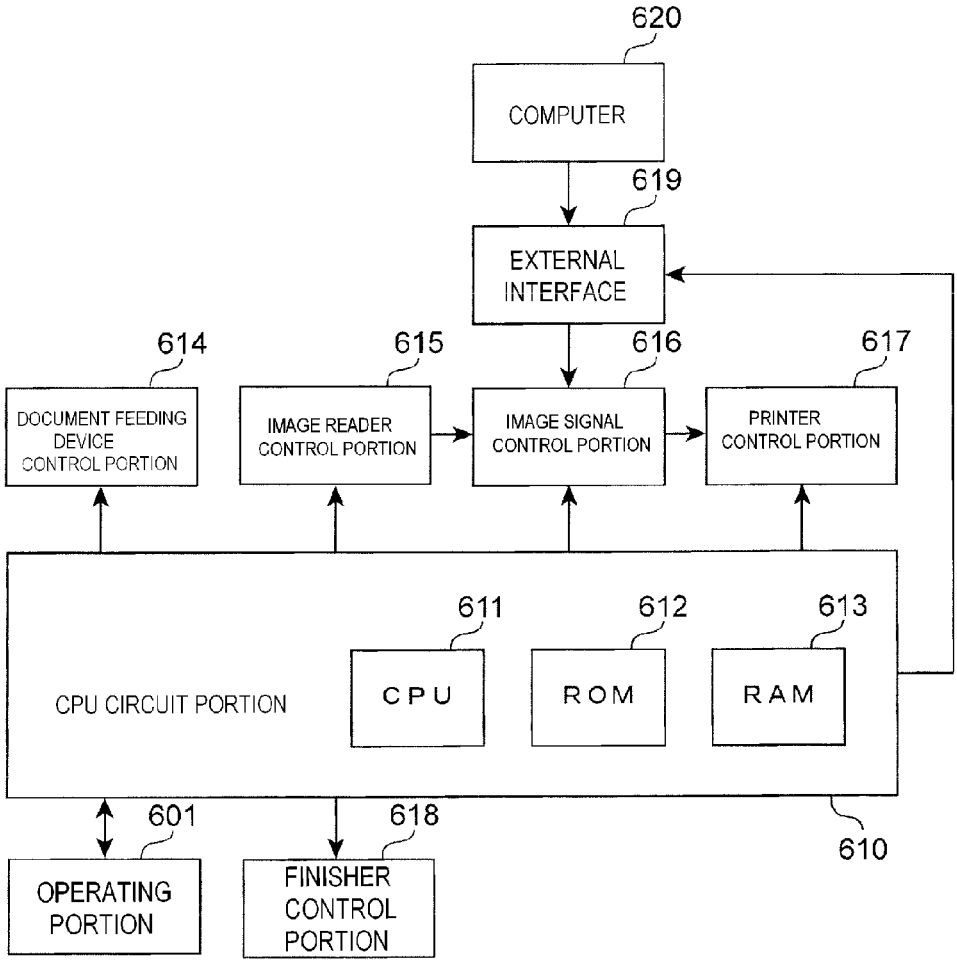
FIG. 3 is a block diagram of a CPU circuit portion which controls the copier according to the present embodiment.
Figure 4:
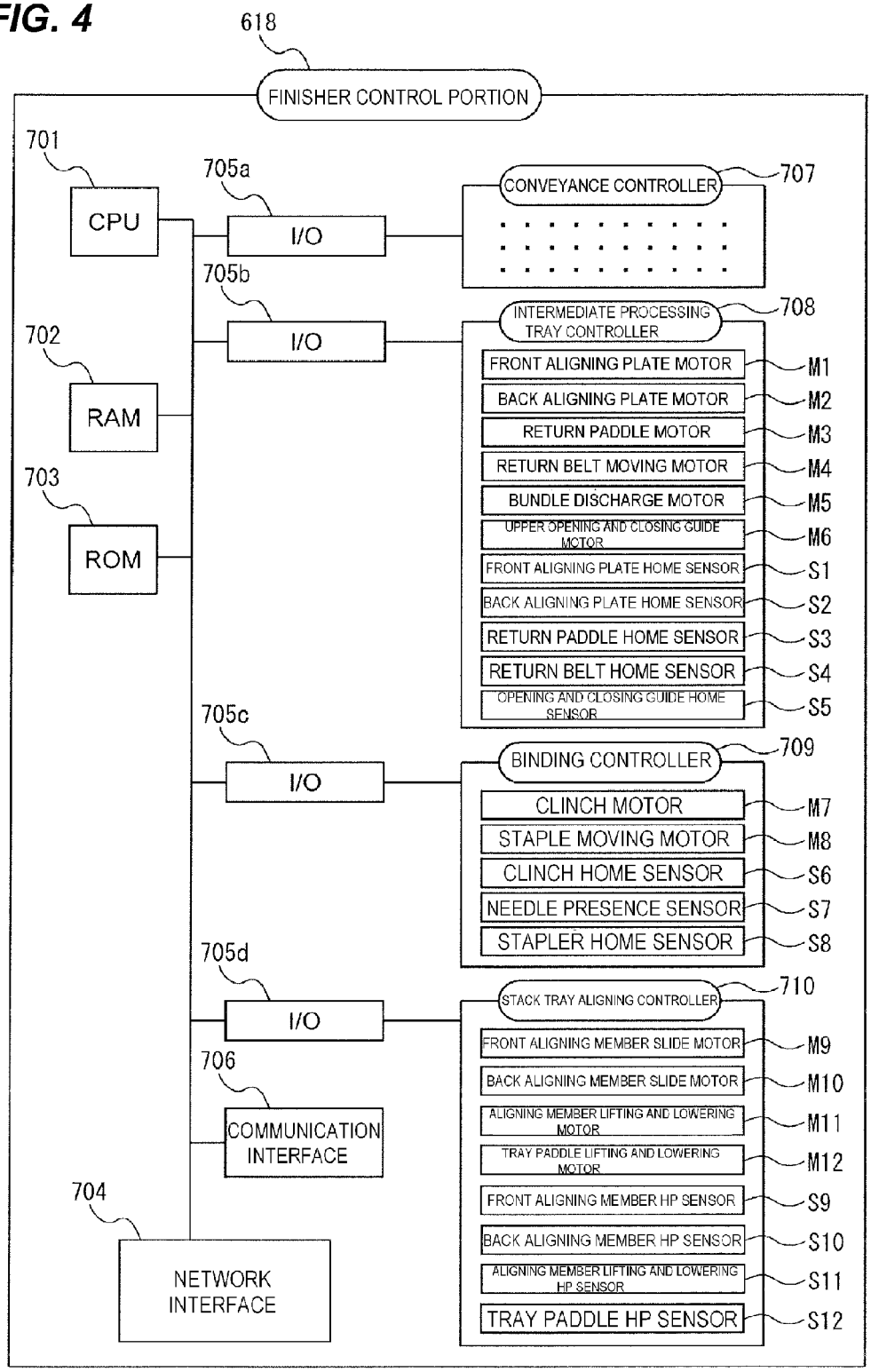
FIG. 4 is a block diagram of a finisher control portion according to the present embodiment.

Next, a CPU circuit portion 610 which controls the copier 1000 according to the present embodiment will be described with reference to FIGS. 3 and 4. FIG. 3 is a block diagram of the CPU circuit portion 610 which controls the copier 1000 according to the present embodiment. FIG. 4 is a block diagram of a finisher control portion 618 as a control portion according to the present embodiment. The present exemplary embodiment describes a case where the finisher control portion 618 is mounted on the finisher 100. However, the present exemplary embodiment is not limited to such a case. For example, the finisher control portion 618 may be provided in the copier body 600 by being integrated with the CPU circuit portion 610 to control the finisher 100 from the copier body 600.

As illustrated in FIG. 3, the CPU circuit portion 610 is provided with a CPU 611, a ROM 612, and a RAM 613. The CPU circuit portion 610 is electrically connected to a document feeding device control portion 614, an image reader control portion 615, an image signal control portion 616, a printer control portion 617, and a finisher control portion 618. The CPU 611 controls the document feeding device control portion 614, the image reader control portion 615, the image signal control portion 616, the printer control portion 617, the finisher control portion 618, and the like in accordance with a program stored in the ROM 612 and instruction information input from the operating portion 601. The RAM 613 is used as an area for temporarily holding control data and a work area for calculation associated with control.

The document feeding device control portion 614 controls the document feeding device 605, and the image reader control portion 615 controls the image reader 606 which reads information of a document fed from the document feeding device 605 (see, FIG. 1). The document data read by the image reader control portion 615 is output to the image signal control portion 616. The printer control portion 617 controls the copier body 600. An external interface 619 is an interface for connecting an external computer 620 and the copier body 600, and, for example, the external interface 619 develops print data input from the external computer 620 into an image and outputs the image data to the image signal control portion 616. The image data output to the image signal control portion 616 is output to a printer control portion 635, and an image is formed in the image forming portion 604.

As illustrated in FIG. 4, the finisher control portion 618 is provided with a CPU (microcomputer) 701, a RAM 702, a ROM 703, input/output portions (I/O) 705*a* to 705*d*, a communication interface 706, and a network interface 704. The finisher control portion 618 is further provided with a conveyance controller 707, an intermediate processing tray controller 708, a binding controller 709, and a stack tray aligning controller 710.

The conveyance controller 707 performs control of the lateral registration detection processing for the sheet P, buffering processing for the sheet P, conveyance processing for the sheet P, and the like. The intermediate processing tray controller 708 performs operation control of front and back aligning plates 340 and 341 to be described later arranged in the processing tray 138, rotation operation control of a drawing paddle 131 to be described later, movement operation control of a belt roller 158 to be described later, opening and closing control of an upper opening and closing guide 149 to be described later, and the like. Movement control of the front and back aligning plates 340 and 341 is executed by controlling a front aligning plate motor M1 and a back aligning plate motor M2 based on, for example, a front aligning plate home sensor S1 and a back aligning plate home sensor S2. The rotation operation control of the drawing paddle 131 is executed by rotation control of a drawing paddle motor M3 based on a drawing paddle home sensor S3, for example. The rotation control of the belt roller 158 is executed by controlling a belt moving motor M4 based on a belt home sensor S4, for example. The opening and closing control of the upper opening and closing guide 149 is executed by controlling an upper opening and closing guide motor M6 based on an upper opening and closing guide home sensor S5, for example.

The binding controller 709 controls clinching, movement, and on the like of the stapler 132, and the controls are executed by controlling a clinch motor M7 and a stapler movement motor M8 based on a clinch home sensor S6, a needle presence sensor S7, and a stapler home sensor S8.

The stack tray aligning controller 710 as a control portion controls movement and the like of an aligning member 1 to be described later and lifting and lowering and the like of a transport holder 50 to be described later by a home position detecting sensor and a movement motor. For example, the control of the aligning member 1 is executed by controlling a front aligning member slide motor M9, a back aligning member slide motor M10, and an aligning member lifting and lowering motor M11 based on a front aligning member HP sensor S9, a back aligning member HP sensor S10, and an aligning member lifting and lowering HP sensor S11. The control of the transport holder 50 is executed by controlling rotation of a transport paddle lifting and lowering motor M12 constituting a moving portion based on a transport paddle HP sensor S12.

Various sensor signals from each of the above control portions of the finisher control portion 618 are input to input ports of input/output portions (I/O) 705*a* to 705*d* and output to each of the above drive systems connected to an output port through a control block (not shown) and various drivers (not shown).

Figure 5:
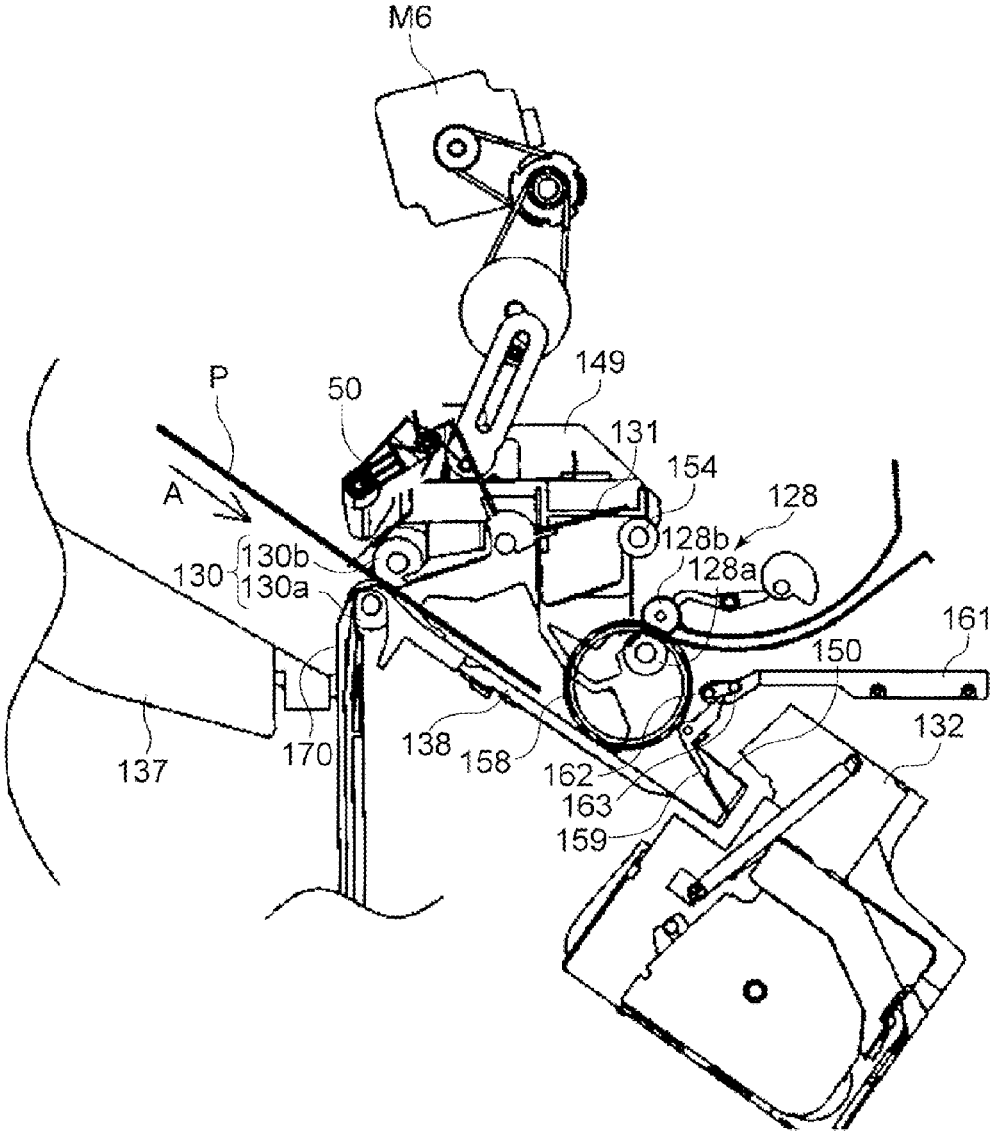
FIG. 5 is a view schematically illustrating a staple portion according to the present embodiment.
Figure 6:
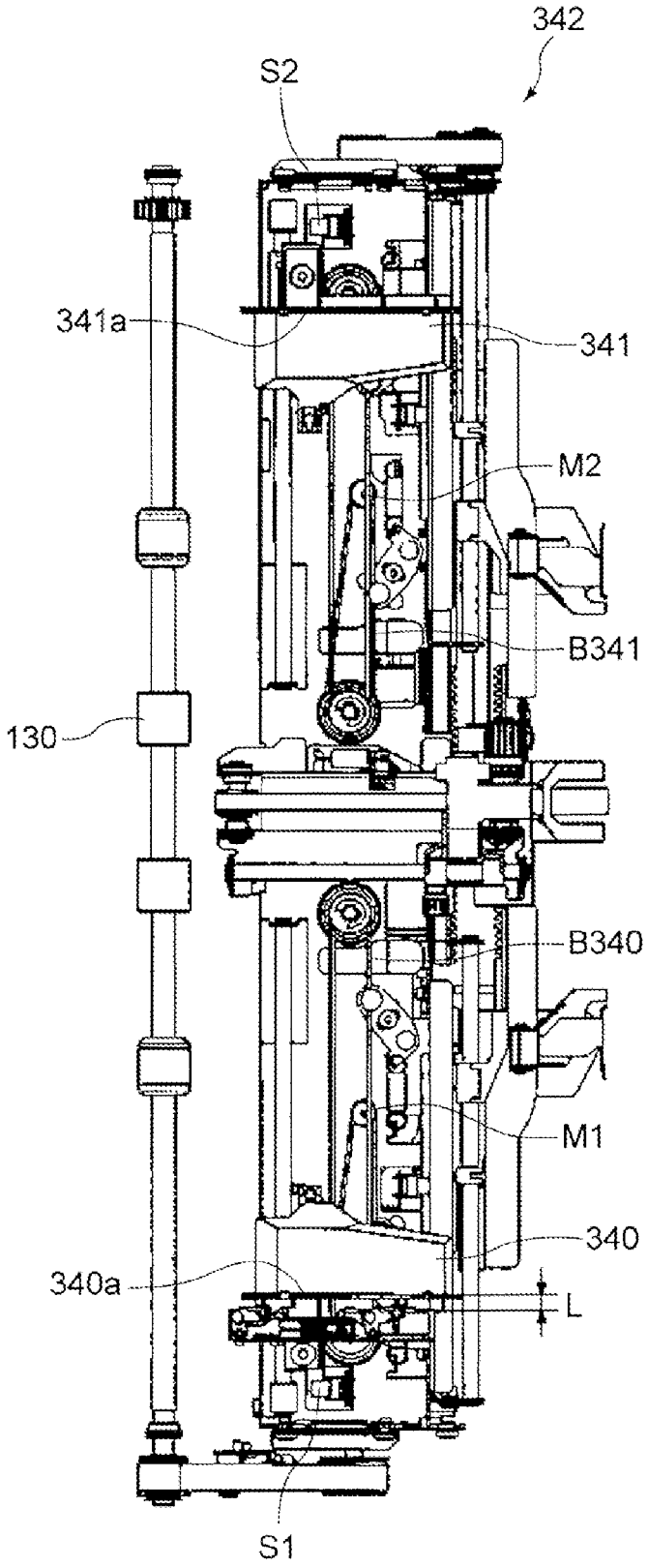
FIG. 6 is a view showing a side end regulating portion according to the present embodiment.
Figure 7:
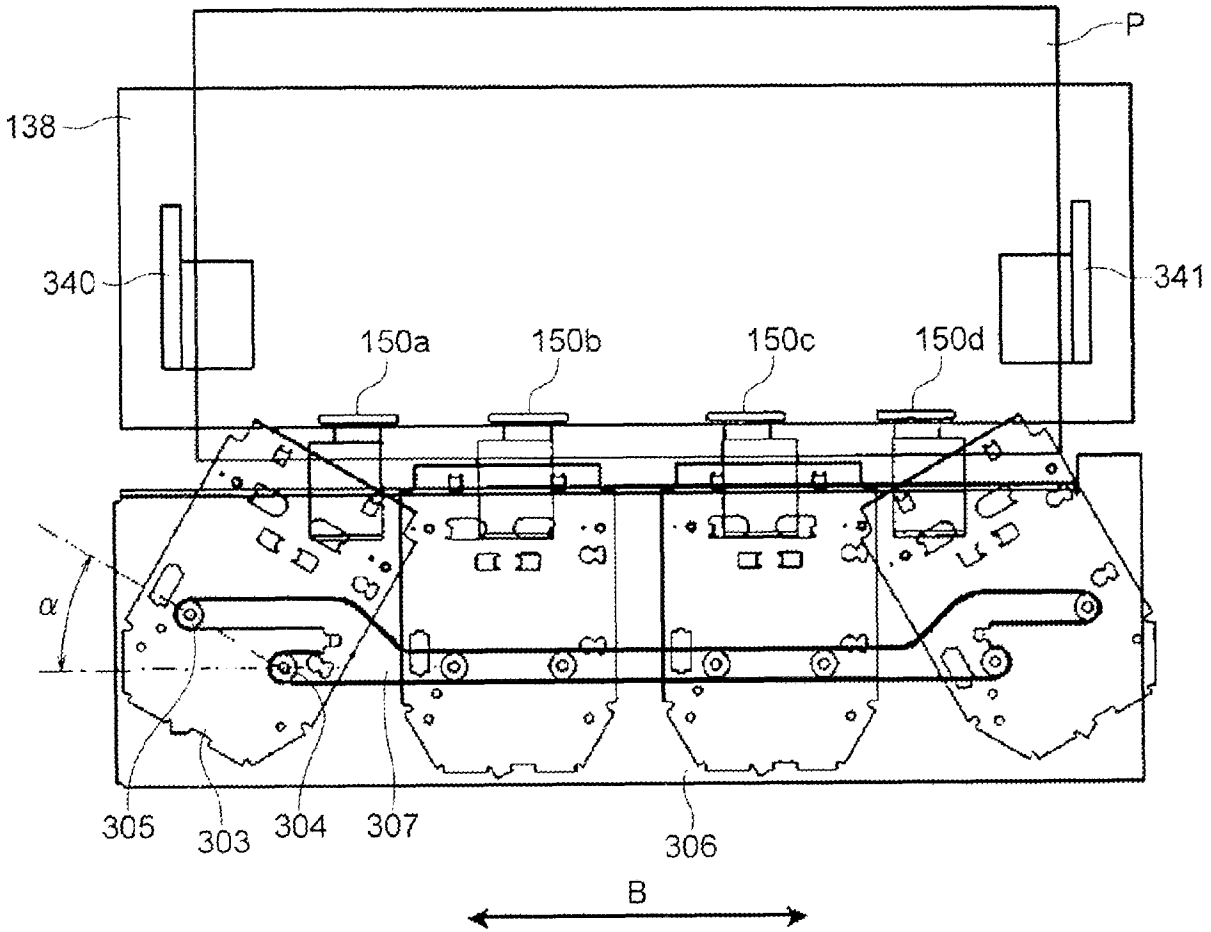
FIG. 7 is a view illustrating a slidable abutment and a stapler moving stage according to the present embodiment.

Next, sheet processing in the staple portion 127 will be described with reference to FIGS. 5 to 8B. First of all, the configuration of the staple portion 127 will be described with reference to FIGS. 5 to 7. FIG. 5 is a view schematically illustrating the staple portion 127 according to the present embodiment. FIG. 6 is a view illustrating a side end regulating portion 342 according to the present embodiment. FIG. 7 is a view illustrating a slidable abutment 303 and a stapler moving stage 306 according to the present embodiment.

As illustrated in FIG. 5, the staple portion 127 is provided with a processing tray 138 as a processing stacking portion. The processing tray 138 is provided so that the downstream side (left side of FIG. 5) is inclined upward in the discharge direction of the sheet P and the upstream side (right side of FIG. 5) is inclined downward, and a rear end stopper 150 is disposed at a lower end portion on the upstream side of the processing tray 138. The rear end stopper 150 is used for alignment in the discharge direction by abutment of the upstream end in the discharge direction of the sheet on the processing tray 138 against the rear end stopper 150.

The drawing paddle 131 and the upper opening and closing guide 149 as a supporting member are arranged at the upper end portion which is the downstream end in the discharge direction of the processing tray 138. The drawing paddle 131 is provided above the processing tray 138, and a plurality of the drawing paddles 131 is fixed on a rotating drive shaft rotated by a drawing paddle motor M3. The drawing paddle 131 is rotated in a counterclockwise direction in FIG. 5 in suitable timing by the drawing paddle motor M3.

The upper opening and closing guide 149 is supported rotatably around a support shaft 154 and functions as an upper conveying guide facing the processing tray 138. The upper opening and closing guide 149 rotatably supports an upper bundle discharge roller 130*b* constituting a bundle discharge roller pair 130 together with a lower bundle discharge roller 130*a* provided at the downstream side end portion of the processing tray 138. Namely, the upper bundle discharge roller 130*b* is separated from the lower bundle discharge roller 130*a* with the upper rotation of the upper opening and closing guide 149 to release a nip between the bundle discharge roller pair 130, and when the upper opening and closing guide 149 is in a closing state, the upper opening and closing guide 149 brings the upper bundle discharge roller 130*b* into contact with the lower bundle discharge roller 130*a* to form a nip between the bundle discharge roller pair 130 so that a sheet bundle and the like can be discharged. When the sheet P is conveyed onto the processing tray 138, the upper opening and closing guide 149 usually rotates upward, and accompanying this, the upper bundle discharge roller 130*b* is in an opening state in which the upper bundle discharge roller 130*b* is separated from the lower bundle discharge roller 130*a*.

When the processing for the sheet P on the processing tray 138 is completed, the upper opening and closing guide 149 is rotated downward by the drive of the upper opening and closing guide motor M6, and a sheet bundle is nipped by the upper bundle discharge roller 130*b* and the lower bundle discharge roller 130*a*. In this embodiment, the bundle discharge roller pair 130 (for example, the lower bundle discharge roller 130*a*) is rotated in forward and backward directions by a bundle discharge motor M5. After that, the bundle discharge roller pair 130 rotates in such a state that the sheet bundle is nipped by the upper bundle discharge roller 130*b* and the lower bundle discharge roller 130*a*, whereby the sheet bundle is discharged onto the lower stack tray 137. The lower stack tray 137 is inclined so that the downstream side in the discharge direction is high. Thus, when the sheet passes through a nip of the bundle discharge roller pair 130, the rear end of the sheet is abutted against an abutment portion 170, provided below the bundle discharge roller pair 130 on a finisher body 400 side (apparatus body side), by the inclination of the lower stack tray 137, and the rear end of the sheet bundle (sheets) is aligned.

The side end regulating portion 342 which regulates (aligns) positions of both side ends in the width direction of the sheet P discharged onto the processing tray 138 is provided in an intermediate portion of the processing tray 138. As illustrated in FIG. 6, the side end regulating portion 342 is provided with the front and back aligning plates 340 and 341 having alignment surfaces 340*a* and 341*a* and the front and back aligning plate motors M1 and M2 independently driving the front and back aligning plates 340 and 341, respectively.

When the positions of the both side ends of the sheet P are regulated, the side end regulating portion 342 transmits the drives of the front and back aligning plate motors M1 and M2 to the front and back aligning plates 340 and 341 through timing belts B340 and B341. According to this constitution, the front and back aligning plates 340 and 341 independently move along the width direction relative to the processing tray 138 and abut against the both side ends of the sheet P staked on the processing tray 138 to align the sheet. Namely, the front and back aligning plates 340 and 341 are arranged so that the alignment surfaces 340*a* and 341*a* face each other on the processing tray 138 and, at the same time, assembled so as to be movable forward and backward in an alignment direction. Consequently, even if the sheet P (sheet bundle) is conveyed while shifted in the width direction, the position of the sheet P on the processing tray 138 can be aligned by the front and back aligning plates 340 and 341.

The side end regulating portion 342 is provided with a front aligning plate home sensor S1 and a back aligning plate home sensor S2 detecting home positions of the front and back aligning plates 340 and 341. When the apparatus is not operated, the front and back aligning plates 340 and 341 are set to be on standby at the home positions of the both end portions.

The staple portion 127 is provided with a sheet rear end aligning portion which aligns the position of the rear end in the discharge direction of the sheet P. The sheet rear end aligning portion is constituted of the drawing paddle 131, the belt roller 158, a rear end lever 159, and the above described rear end stopper 150. While the sheet P conveyed onto the processing tray 138 is guided by the rear end lever 159 by the counterclockwise rotation of the drawing paddle 131 and the belt roller 158, the upstream end in the conveying direction of the sheet P is abutted against the rear end stopper 150. Consequently, the position of the rear end in the discharge direction of the sheet P is aligned.

The belt roller 158 being an endless belt is provided above the processing tray 138 liftably and lowerably (movably) and, at the same time, wound around an outer periphery of a lower discharge roller 128*a* constituting the lower discharge roller pair 128. The belt roller 158 is held by holding rollers 162 and 163 provided at the front end of a belt moving member 161. The belt roller 158 rotates in the counterclockwise direction in accordance with the rotation of the lower discharge roller 128*a* while maintaining such a positional relationship that the lower portion is in contact with the uppermost sheet stacked on the processing tray 138 in such a state that the belt roller 158 is held by the holding rollers 162 and 163. The sheet conveyed onto the processing tray 138 is conveyed in the opposite direction to the conveyance direction to abut against the rear end stopper 150. The position of the belt moving member 161 is controlled while the belt home sensor S4 detects an edge of the belt moving member 161.

The staple portion 127 is provided with the stapler 132 which binds the end of the sheet bundle by the clinch motor M7, and the stapler 132 is fixed onto the slidable abutment 303. As illustrated in FIG. 7, rolling rollers 304 and 305 are arranged in the lower portion of the slidable abutment 303, and a guide rail groove 307 is formed on the stapler moving stage 306. The stapler 132 is traveled in an arrow B direction shown in FIG. 7 along the rear end edge of the sheet by the stapler movement motor M8 while guided by the rolling rollers 304 and 305 and the guide rail groove 307.

The attitude of the stapler 132 is maintained so as to be inclined by a predetermined angle $\alpha$ relative to the rear end edge of the sheet P in the corner of the sheet P stacked on the processing tray 138. In this embodiment, although the inclination angle $\alpha$ is set to about 30 degrees, the inclination angle can be changed by changing the shape of the guide rail groove 307. The stapler moving stage 306 is provided with the staple home sensor S8 which detects the home position of the stapler 132. The stapler 132 is usually on standby in the home position on the front side of the apparatus.

Figure 8A:
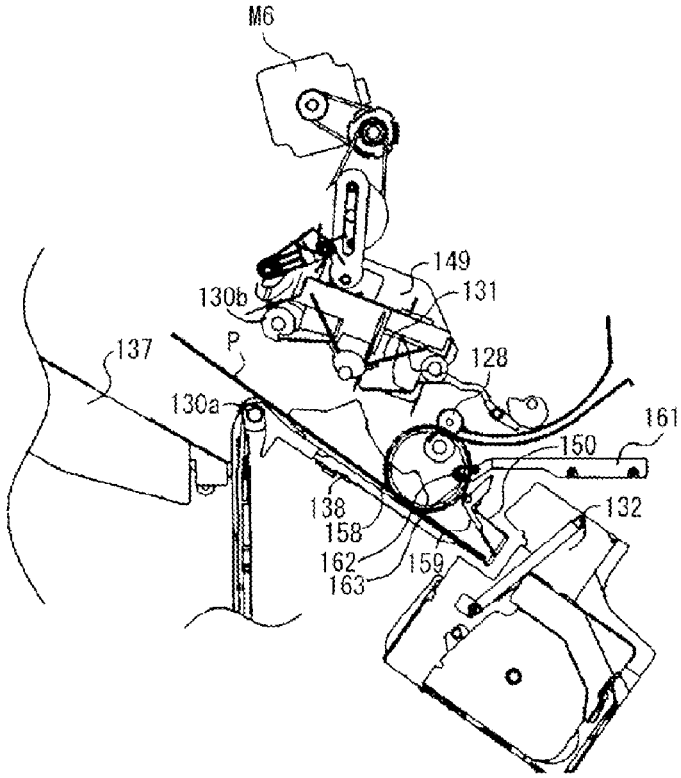
FIG. 8A is a view illustrating a state in which an upper opening and closing guide is lifted.
Figure 8B:
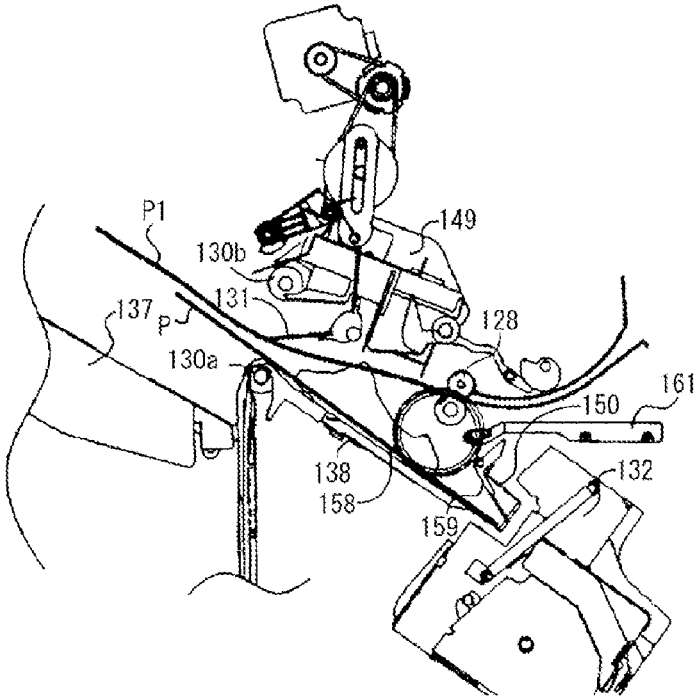
FIG. 8B is a view showing a state in which a drawing paddle rotates.

Next, the sheet processing in the staple portion 127 will be described with reference to FIGS. 5, 8A, and 8B. In this embodiment, the sheet processing will be described using a staple sort mode as an example of a staple mode performed by the stapler portion 127. FIG. 8A is a view illustrating a state in which the upper opening and closing guide 149 is lifted. FIG. 8B is a view illustrating a state in which the drawing paddle 131 rotates.

When the staple sort mode is selected, a first sheet P of a first bundle discharged from the copier body 600 is conveyed while shifted by a predetermined amount to the front side by the shift unit 108 and is conveyed to the bundle discharge roller pair 130 by the lower discharge roller pair 128.

As illustrated in FIG. 5, when the rear end of the sheet P passes through a nip portion of the lower discharge roller pair 128 and conveyed by a predetermined amount by the bundle discharge roller pair 130, the bundle discharge roller pair 130 is reversed in an arrow A direction shown in FIG. 5. Consequently, the rear end of the sheet P is conveyed to abut against the rear end stopper 150. At this time, the front and back aligning plates 340 and 341 are on standby at a front side offset aligning standby position previously shifted from the center of the processing tray 138 to the front side. The aligning standby position at this time is a position retracted by 10 mm from the both sides of the sheet P relative to the discharge position of the sheet P (position shifted from the center to the front side), and the front and back aligning plates 340 and 341 wait the discharge operation of the sheet P in the aligning standby position.

As illustrated in FIG. 8A, the upper opening and closing guide 149 is lifted before the rear end of the sheet P abuts against the rear end stopper 150, the lower bundle discharge roller 130*a* and the upper bundle discharge roller 130*b* are spaced apart from each other, and the sheet P is aligned in the discharge direction (the rear end of the sheet P is aligned). When the alignment of the sheet P in the discharge direction (the rear end of the sheet P) is completed, the front and back aligning plates 340 and 341 are operated from the aligning standby position to the aligning position, and the alignment in the width direction is performed.

Next, as illustrated in FIG. 8B, a second sheet P1 of the first copy is discharged from the lower discharge roller pair 128 to the processing tray 138 in timing in which the alignment of the first sheet P of the first copy in the width direction is completed. At this time, the upper opening and closing guide 149 is already located in the lifted position as described above. Thus, the sheet P is received in such a state that the upper bundle discharge roller 130*b* and the lower bundle discharge roller 130*a* are spaced apart from each other and in such a state that the front and back aligning plates 340 and 341 are on standby at the front side offset aligning standby position previously shifted from the center of the processing tray 138 to the front side. When the rear end of the sheet P1 passes through the nip portion of the lower discharge roller pair 128, the sheet P1 is discharged onto the processing tray 138. When the drawing paddle 131 is rotated in the counterclockwise direction, the sheet P1 discharged onto the processing tray 138 is conveyed so that the rear end faces the rear end stopper 150. The sheet P1 is further drawn to the rear end stopper 150 by the belt roller 158 rotating in the counterclockwise direction to abut against the rear end stopper 150, and, thus, to align the sheet P1 in the discharge direction.

When the alignment of the sheet P1 in the discharge direction (the rear end of the sheet P) is completed, as with the first sheet, the sheet P1 is aligned in the width direction by the front and back aligning plates 340 and 341. With regard to the third and fourth sheets, the similar alignment is repeated to stack the sheets, and, thus, to form a sheet bundle. When the alignment of a last sheet is completed, the staple processing by the stapler 132 is performed, and the sheet bundle is discharged onto the lower stack tray 137 by the bundle discharge roller pair 130.

Figure 9A:
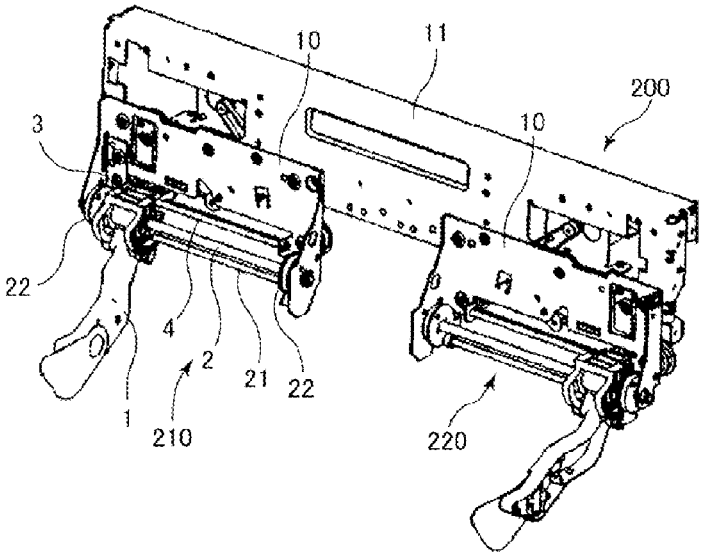
FIG. 9A is a perspective view of a width direction aligning portion as viewed from one side.

Next, the width direction aligning portion 200 which performs the alignment processing in the width direction perpendicular to the discharge direction of the sheet discharged onto the lower stack tray 137 will be described with reference to FIGS. 2 and 9A to 9C. FIG. 9A is a perspective view of the width direction aligning portion 200 as viewed from one side.

Figure 9B:
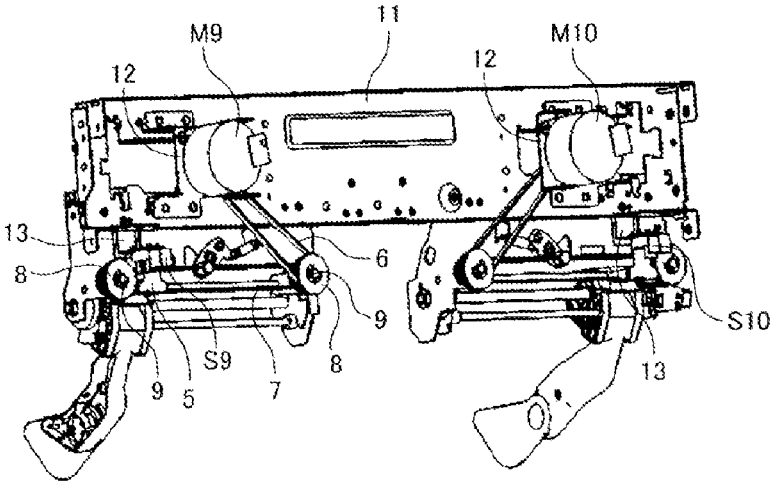
FIG. 9B is a perspective view of a width direction aligning portion as viewed from the other side.
Figure 9C:
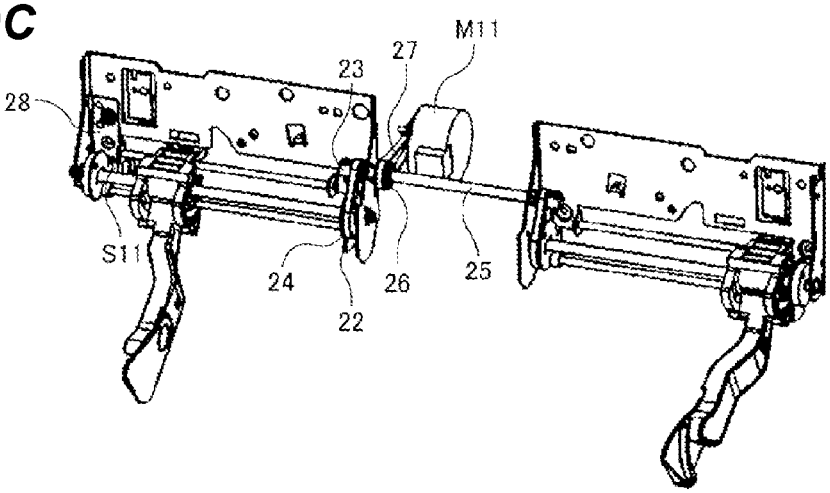
FIG. 9C is a perspective view illustrating a connected state between a back alignment unit and a front alignment unit.

FIG. 9B is a perspective view of the width direction aligning portion 200 as viewed from the other side. FIG. 9C is a perspective view illustrating a connected state between a back alignment unit 210 and a front alignment unit 220.

As illustrated in FIG. 2, the width direction aligning portion 200 is provided above the lower stack tray 137 and as illustrated in FIG. 9A provided with the front alignment unit 220 disposed on the front side, the back alignment unit 210 disposed on the back side, and an upper stay 11. The front alignment unit 220 and the back alignment unit 210 are attached symmetrically with respect to the upper stay 11. Since the front alignment unit 220 and the back alignment unit 210 have the same configuration, only the configuration of the back alignment unit 210 will be described hereinafter, and a description of the configuration of the front alignment unit 220 is omitted.

The back alignment unit 210 is provided with an arm-like aligning member 1. A base end of the aligning member 1 is supported by a slide member 3 slidably supported by a first aligning spindle 2, and the aligning member 1 is moved in the front and depth directions by the slide member 3 sliding along the first aligning spindle 2. The slide member 3 is rotatably and slidably supported by the first aligning spindle 2 as a rotation center and, at the same time, supported as a rotation stopper by a second aligning spindle 4.

The slide member 3, as illustrated in FIG. 9B, nipps a second slide drive transmission belt 7 together with a slide position detecting member 5, and the both ends of the second slide drive transmission belt 7 are hung between slide drive transmission pulleys 8, 8. The slide drive transmission pulleys 8, 8 are rotatably supported by a pulley spindle 9 connected by caulking to a pulley spindle 10. The slide drive transmission pulleys 8, 8 are stage pulleys and engage with a first slide drive transmission belt 6. The first slide drive transmission belt 6 engages with the back aligning member slide motor M10. The aligning member 1 is configured so that the drive of the back aligning member slide motor M10 is transmitted through the first slide drive transmission belt 6, the slide drive transmission pulleys 8, 8, the second slide drive transmission belt 7, and the slide member 3, and the aligning member 1 moves in the front-back direction along the first aligning spindle 2.

The aligning member 1 engages with a third alignment spindle 21 as a rotation stopper, and the both ends of the third alignment spindle 21 are supported by aligning member lifting and lowering pulleys 22, 22 supported by the first aligning spindle 2. Since the first aligning spindle 2 and the aligning member lifting and lowering pulley 22, 22 are engaged with a parallel pin, the rotation of the aligning member lifting and lowering pulley 22 and the rotation of the aligning member lifting and lowering pulley 22 are synchronized with each other. According to this constitution, when the aligning member lifting and lowering pulleys 22, 22 rotate, the third alignment spindle 21 also rotates and moves around the first aligning spindle 2, so that the aligning member 1 engaging with the third alignment spindle 21 rotates.

As illustrated in FIG. 9C, an aligning member lifting and lowering pulley 22 is connected to a second lifting and lowering pulley 23 through a drive transmission belt 24, and the front and back sides of the second lifting and lowering pulley 23 are attached to a lifting and lowering transmission shaft 25 with D-cut portions. A third lifting and lowering pulley 26 engages with the lifting and lowering transmission shaft 25, and the third lifting and lowering pulley 26 is connected to the aligning member lifting and lowering motor M11 through a drive transmission belt 27. According to this constitution, the drive of the aligning member lifting and lowering motor M11 is transmitted to the third lifting and lowering pulley 26 through the drive transmission belt 27 and transmitted to the aligning member lifting and lowering pulley 22 through the lifting and lowering transmission shaft 25, the second lifting and lowering pulley 23, and the drive transmission belt 24. Consequently, the aligning member lifting and lowering pulley 22 rotates, and the aligning member 1 is lifted and lowered through the third alignment spindle 21. At this time, a flag portion of the aligning member lifting and lowering pulley 22 turns ON/OFF the aligning member lifting and lowering HP sensor S11 which detects the lifting and lowering positions of the aligning member 1, whereby the lifting and lowering positions of the aligning member 1 is detected and controlled. The drive of the aligning member lifting and lowering motor M11 is thus transmitted to the lifting and lowering of the aligning member 1 of the front alignment unit 220 and the aligning member 1 of the back alignment unit 210, and the aligning member 1 of the front alignment unit 220 and the aligning member 1 of the back alignment unit 210 are rotated and position-controlled while being in synchronization with each other in the lifting and lowering (rotation).

Figure 10:
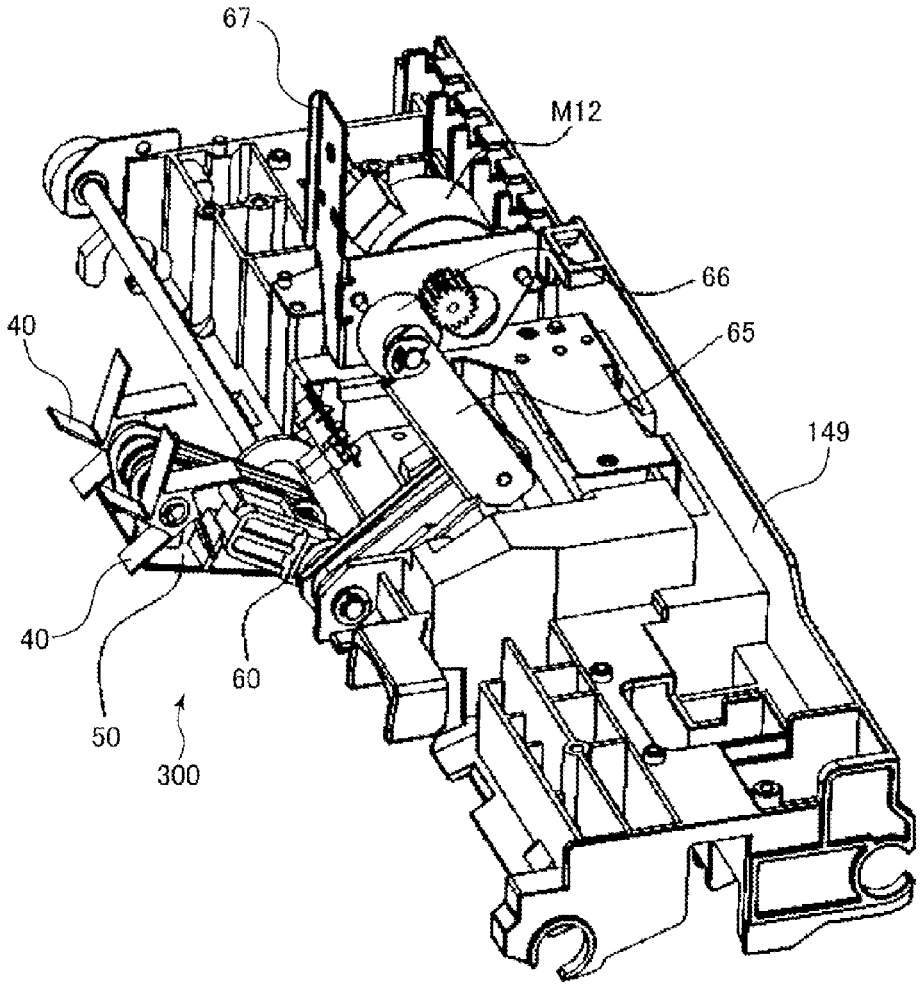
FIG. 10 is a perspective view illustrating a discharge direction aligning portion supported by the upper opening and closing guide.
Figure 11A:
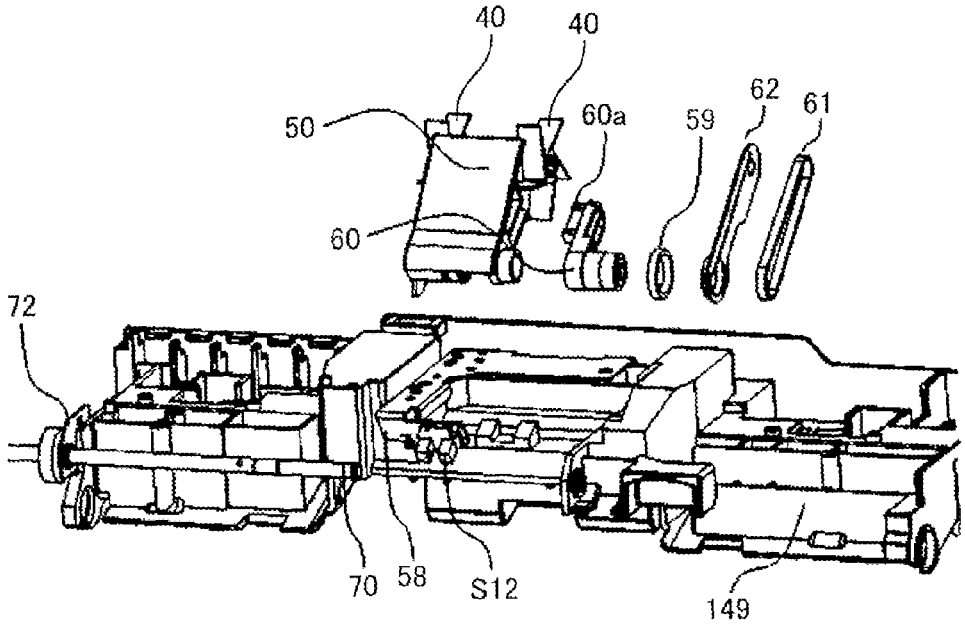
FIG. 11A is an exploded perspective view of the discharge direction aligning portion.
Figure 11B:
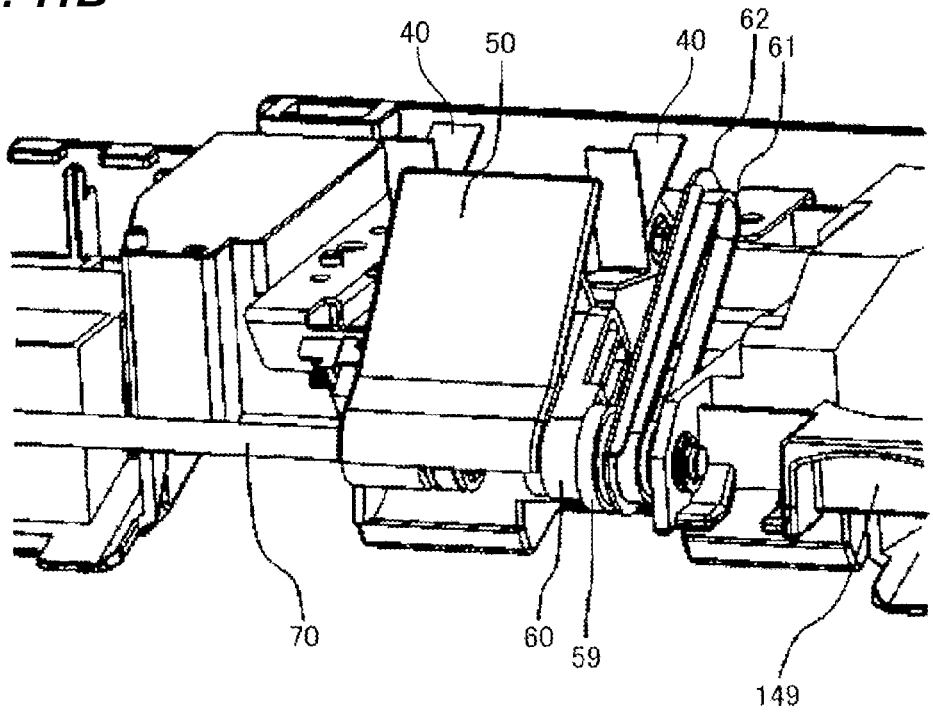
FIG. 11B is a partially enlarged view of the discharge direction aligning portion located at a retracting position.
Figure 12A:
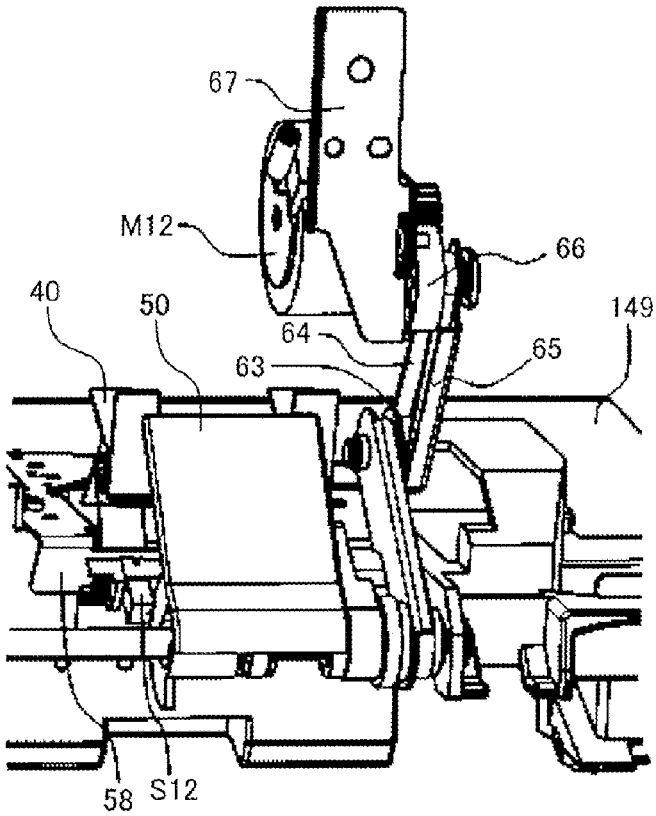
FIG. 12A is a view illustrating a lifting and lowering motor abutment for attaching the discharge direction aligning portion to an upper stay.
Figure 12B:
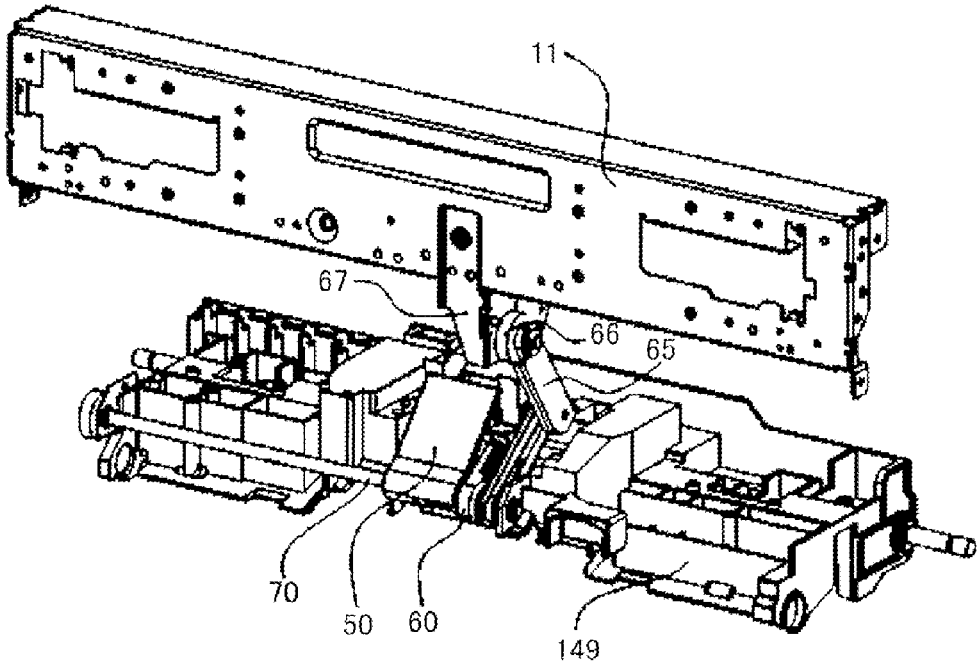
FIG. 12B is a perspective view illustrating the discharge direction aligning portion attached to the upper stay.
Figure 13A:
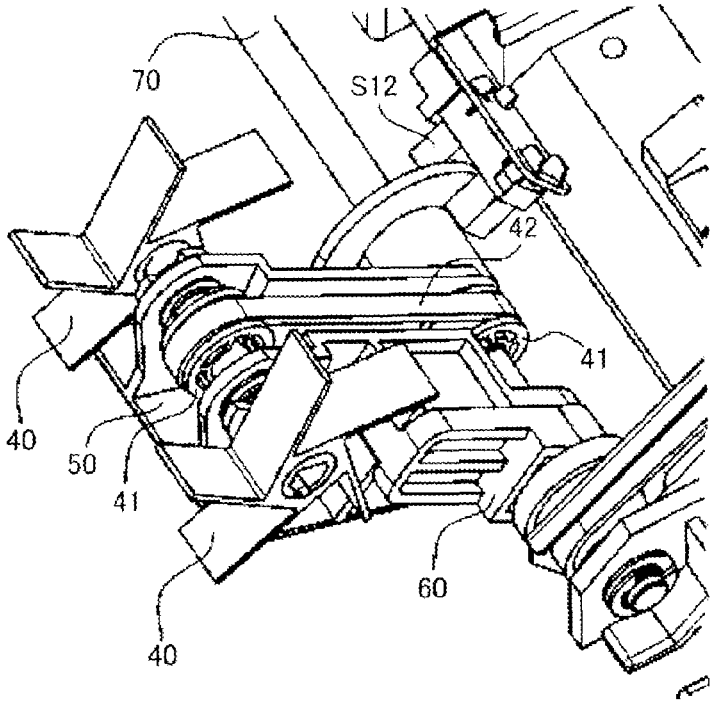
FIG. 13A is a view illustrating a transport paddle and the like held by a transport holder.
Figure 13B:
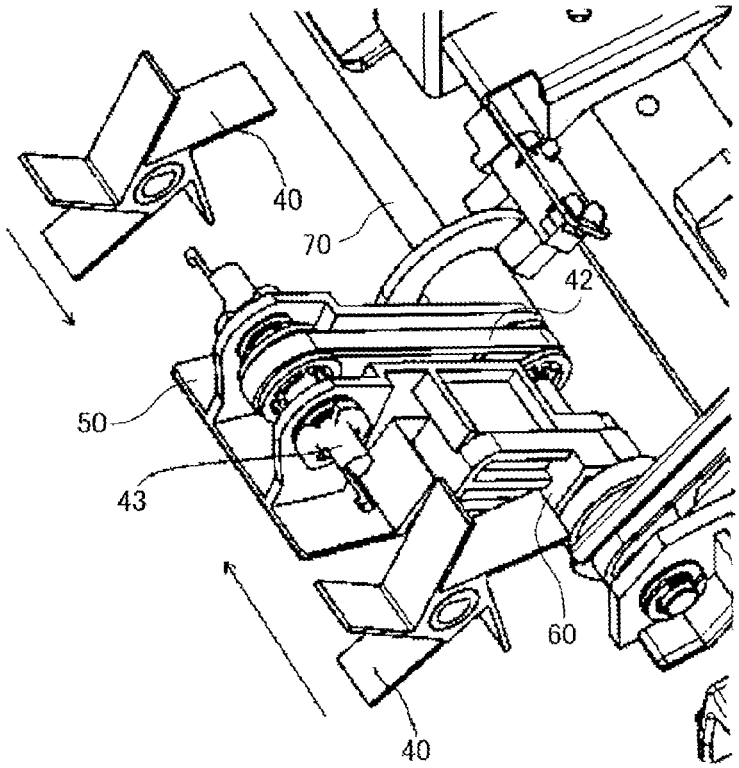
FIG. 13B is an exploded perspective view of FIG. 13A.
Figure 14A:
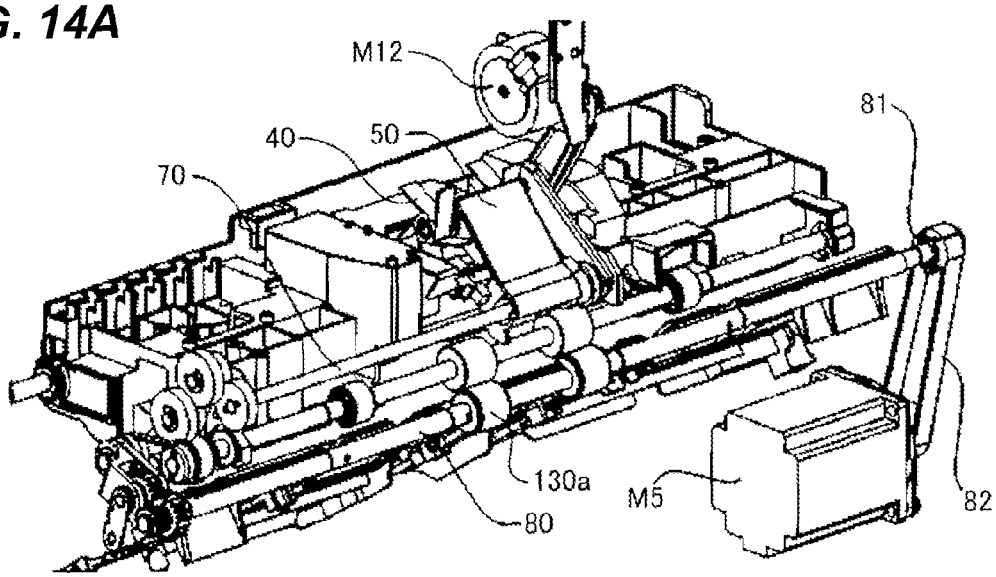
FIG. 14A is a perspective view illustrating the discharge direction aligning portion connected to a bundle discharge motor.
Figure 14B:
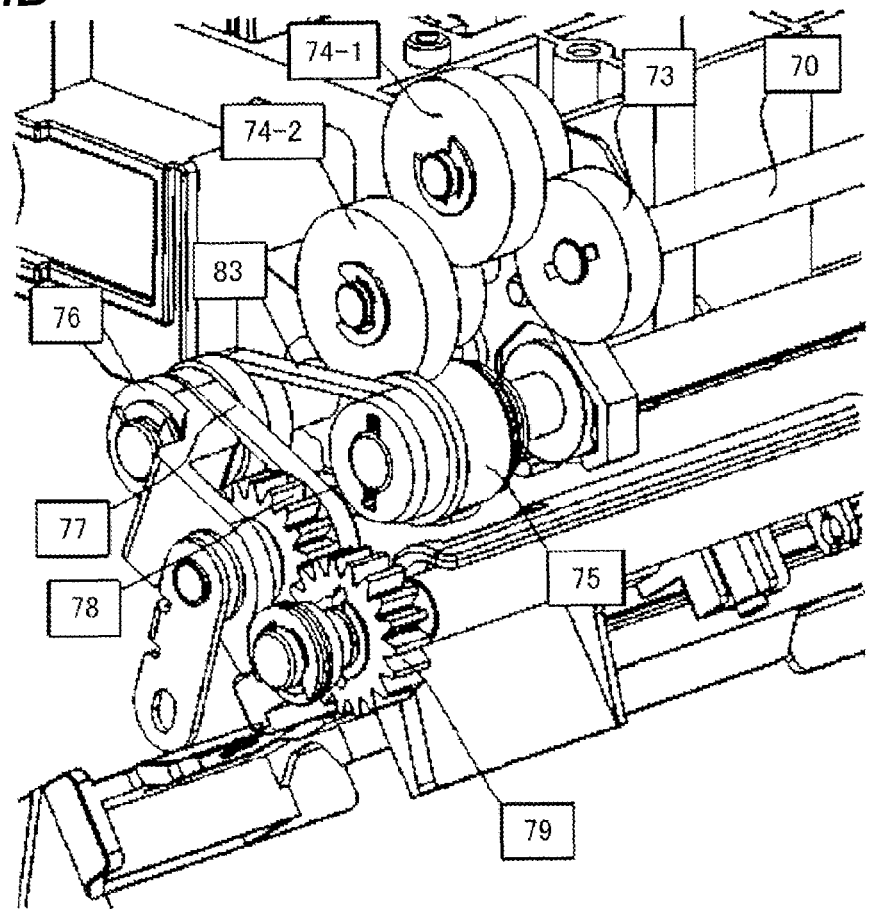
FIG. 14B is a partially enlarged view illustrating a gear train of FIG. 14A.

Next, the discharge direction aligning portion 300 which performs the alignment processing in the sheet discharge direction for the sheet discharged onto the lower stack tray 137 will be described with reference to FIGS. 10 to 14B. FIG. 10 is a perspective view illustrating the discharge direction aligning portion 300 supported by the upper opening and closing guide 149. FIG. 11A is an exploded perspective view of the discharge direction aligning portion 300. FIG. 11B is a partially enlarged view of the discharge direction aligning portion 300 located at a retracting position. FIG. 12A is a view illustrating a lifting and lowering motor abutment 67 for attaching the discharge direction aligning portion 300 to the upper stay 11. FIG. 12B is a perspective view illustrating the discharge direction aligning portion 300 attached to the upper stay 11. FIG. 13A is a view illustrating a transport paddle 40 and the like held by the transport holder 50. FIG. 13B is an exploded perspective view of FIG. 13A. FIG. 14A is a perspective view illustrating the discharge direction aligning portion 300 connected to the bundle discharge motor M5. FIG. 14B is a partially enlarged view illustrating a gear train of FIG. 14A.

As illustrated in FIG. 10, the discharge direction aligning portion 300 is supported at a substantially central portion in the front-back direction of the upper opening and closing guide 149 as a supporting member, and the discharge direction aligning portion 300 is configured to be located above the sheet P discharged from the processing tray 138 by being provided above the upper bundle discharge roller 130*b*. As illustrated in FIGS. 11A and 11B, the discharge direction aligning portion 300 has transport paddles 40, 40 as transport members (rotating members) and the transport holder 50 as a rotating lever. The transport paddles 40, 40 are rotatably supported at the front end of the transport holder 50, and the base end of the transport holder 50 is supported by a transport spindle 70. The transport spindle 70 is rotatably supported by the upper opening and closing guide 149 so as to be located above the upper bundle discharge roller 130*b*, whereby the transport holder 50 is rotated above the upper bundle discharge roller 130*b*. One end (back side) of the transport spindle 70 is supported by the upper opening and closing guide 149 through a gear support plate 72.

The other end (front side) of the transport spindle 70 is connected to a transport member lifting and lowering pulley 60 whose front end 60*a* is fitted in the transport holder 50, and the rotation of the transport holder 50 and the rotation of the transport spindle 70 are synchronized with each other. The transport member lifting and lowering pulley 60 is connected to a drive transmission belt 61 and a first lifting and lowering link 62 through a lifting and lowering pulley spacer 59, and the drive transmission belt 61 and the first lifting and lowering link 62 are connected to a lifting and lowering link pulley 63 (see, FIGS. 12A and 12B). The lifting and lowering link pulley 63 is connected to the transport paddle lifting and lowering motor M12 through a drive transmission belt 64 and a lifting and lowering gear 66 to which a second lifting and lowering link 65 is attached for the purpose of keeping a shaft-to-shaft distance of the drive transmission belt 64. The transport paddle lifting and lowering motor M12 is attached to the lifting and lowering motor abutment 67, and the lifting and lowering motor abutment 67 is attached to the upper stay 11. According to this constitution of the moving portion, the driving force of the transport paddle lifting and lowering motor M12 can be transmitted to the transport holder 50, and the transport holder 50 can be rotated around a transport spindle 70. Namely, the transport paddle 40 supported by the front end of the transport holder 50 can become movable freely.

The rotation of the transport holder 50 is detected by the transport paddle HP sensor S12 attached to the upper opening and closing guide 149 through a sensor plate 58, and position control is performed by the stack tray aligning controller 710 of the finisher control portion 618. Specifically, the transport holder 50 is controlled to move between a standby position as a first position where the transport holder 50 is on standby above the bundle discharge roller pair 130 and a transporting position as a second position where the sheet is sandwiched in between the transport holder 50 and a stacking surface of the lower stack tray 137 and, at the same time, the sheet is abutted against an abutment portion 170. Further, after completion of an image forming job, the transport holder 50 is controlled to move to a retracting position as a third position where the transport holder 50 is stored in the upper opening and closing guide 149. The transport holder 50 is configured to be usually located in the retracting position as a home position. The retracting position is provided in the upper opening and closing guide 149 so as not to interfere with the rotation operation of the upper opening and closing guide 149 in the finisher body 400 (in the apparatus body).

The transport paddles 40, 40 are formed by radially securing a plurality of paddles to a rotation shaft. As illustrated in FIGS. 13A and 13B, the transport paddles 40, 40 are connected to the both ends of a transport shaft 43 rotatably supported by the front end of the transport holder 50. The transport shaft 43 is connected to a transport pulley 41 through a drive transmission belt 42 hung between the transport pulleys 41 attached to a substantially central portion of the transport shaft 43. The transport pulley 41 is attached to the other end of the transport spindle 70 (front side). The transport shaft 43 and the transport pulley 41 are engaged with a parallel pin, and the transport spindle 70 and the transport pulley 41 are also engaged with a parallel pin, whereby the rotation of the transport paddle 40 and the rotation of the transport spindle 70 are synchronized with each other.

As illustrated in FIGS. 14A and 14B, the gear train supported by the gear support plate 72 (see, FIG. 11) is connected to an end of the transport spindle 70. The gear train is drive-connected between components from a transport drive gear 73 connected to the end of the transport spindle 70 to a discharge gear 79 and, namely, drive-connected to the transport drive gear 73, transport drive gears 74-1 and 74-2, a discharge drive W pulley 75, a discharge drive belt 83, a discharge connection W pulley 76, a discharge transmission belt 77, a discharge drive W gear 78, and the discharge gear 79.

The discharge gear 79 is connected to a discharge drive pulley 81 through the lower bundle discharge roller 130*a* of the bundle discharge roller pair 130, and the discharge drive pulley 81 is connected to the bundle discharge motor M5 through a drive transmission belt 82. Namely, the bundle discharge motor M5 is a common drive source which rotates the transport paddles 40, 40 and the lower bundle discharge roller 130*a*. The transport paddles 40, 40 and the lower bundle discharge roller 130*a* use the common drive source, whereby the number of components can be reduced.

Next, alignment processing for the sheet P on the lower stack tray 137 by the finisher control portion 618 of the finisher 100 configured as above will be described with reference to FIGS. 15A to 19. In this example, the alignment processing will be described using an unbinding sort mode performed when an unbound sheet not subjected to the staple processing is discharged onto the lower stack tray 137.

Figure 15A:
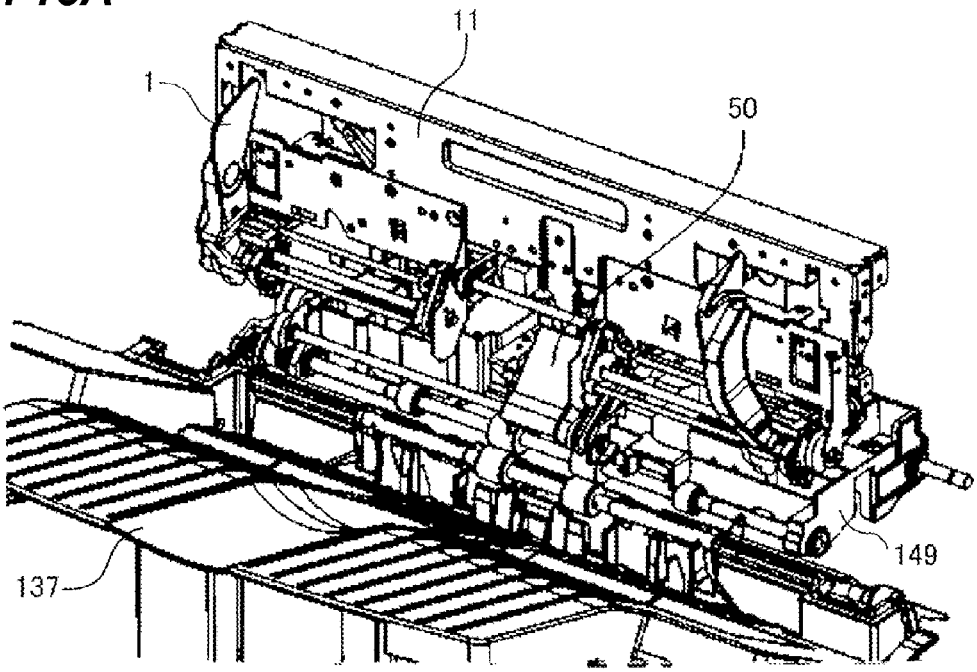
FIG. 15A is a perspective view illustrating the transport paddle located at the retracting position.
Figure 15B:
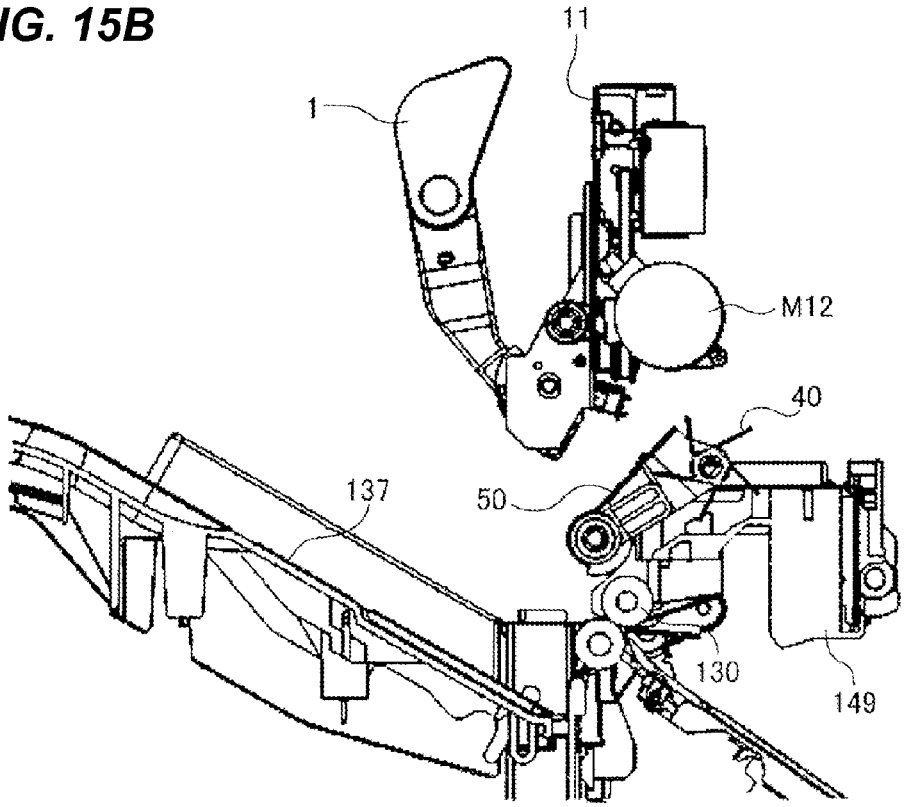
FIG. 15B is a cross-sectional view of FIG. 15A.
Figure 16A:
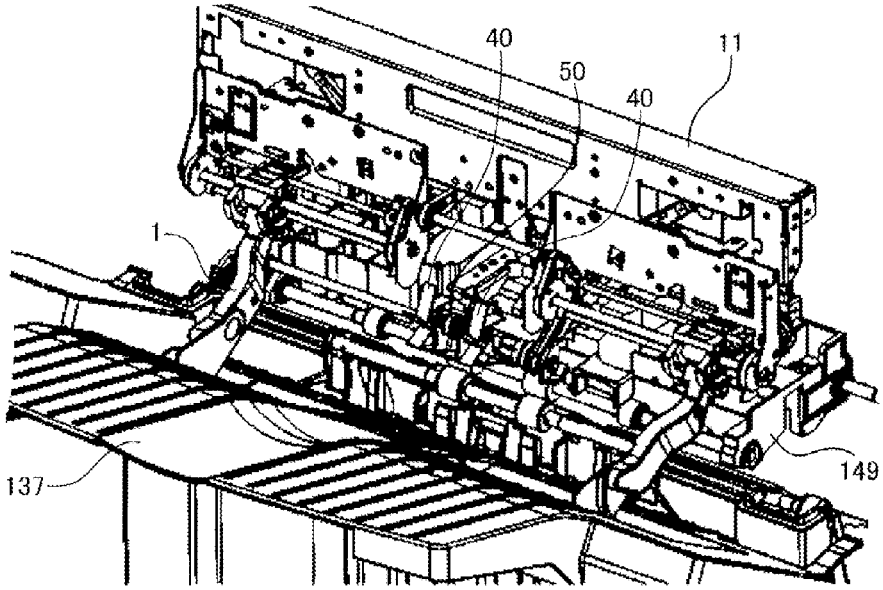
FIG. 16A is a perspective view illustrating the transport paddle located at a standby position.
Figure 16B:
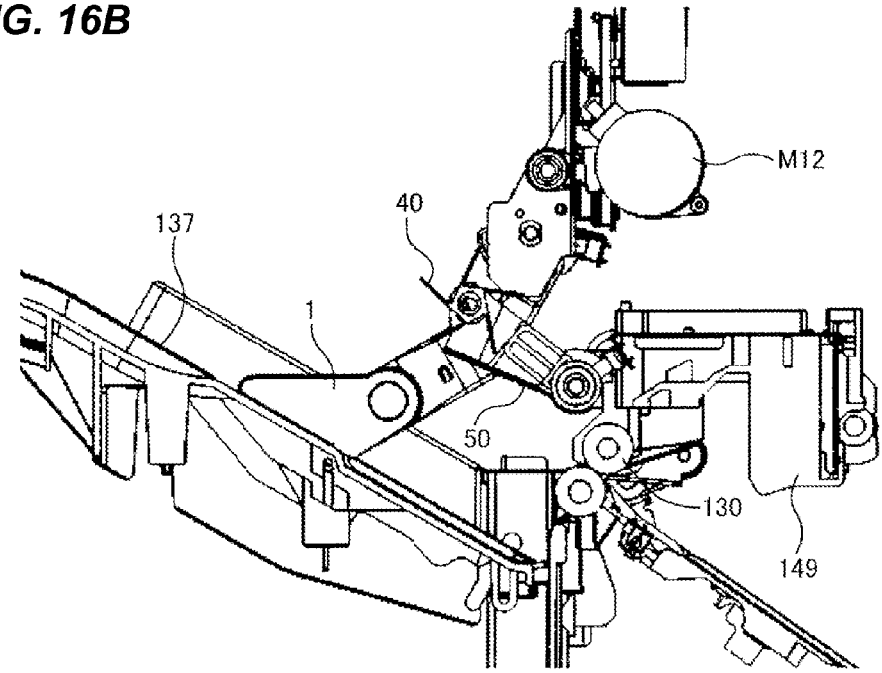
FIG. 16B is a cross-sectional view of FIG. 16A.
Figure 17:
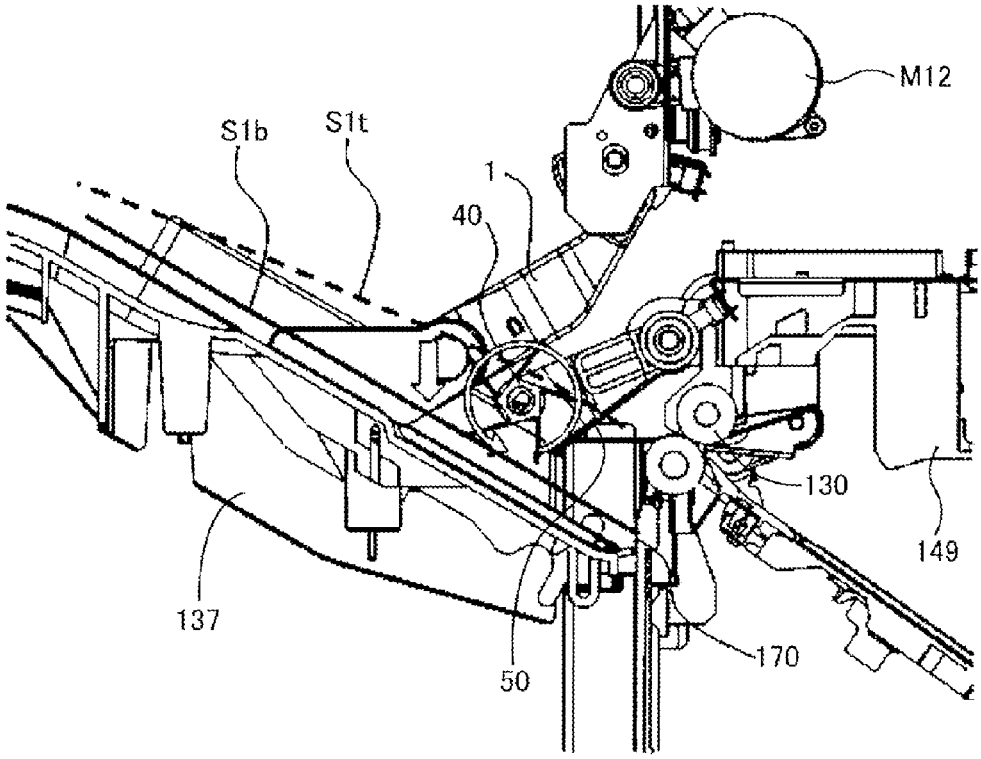
FIG. 17 is a cross-sectional view illustrating the transport paddle located in a transporting position.
Figure 18A:
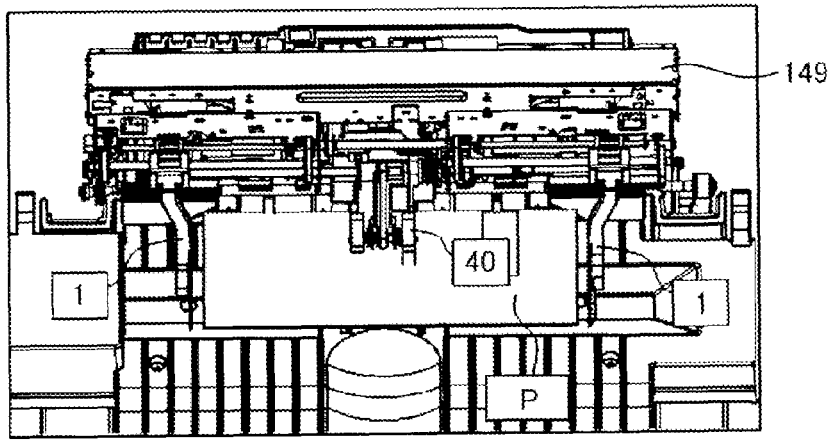
FIG. 18A is a view illustrating a state in which a sheet is discharged onto a lower stack tray.
Figure 18B:
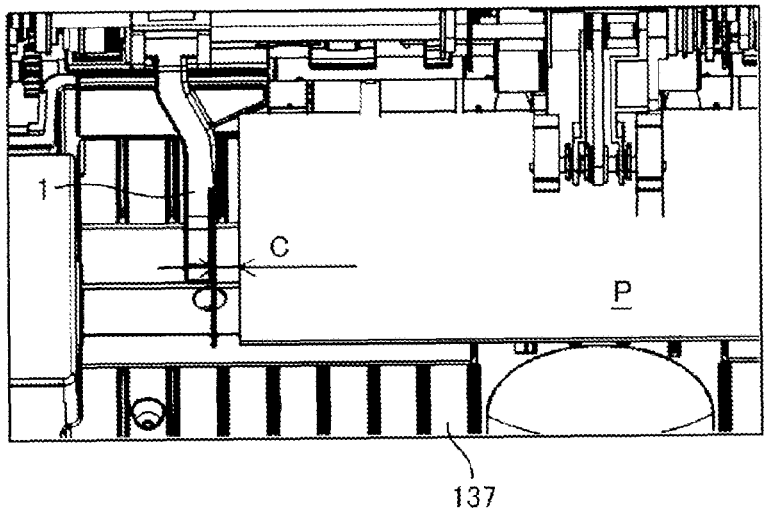
FIG. 18B is a partially enlarged view of FIG. 18A.
Figure 18C:
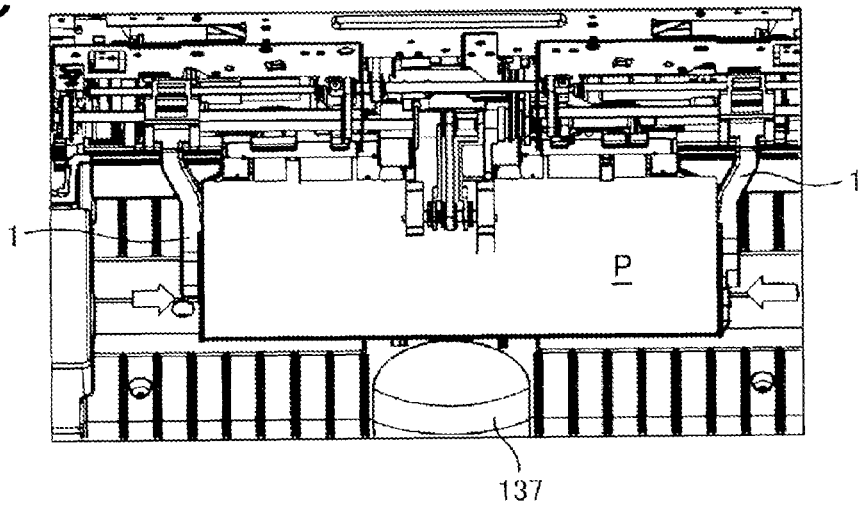
FIG. 18C is a view illustrating a state in which the sheet is aligned in a width direction.

FIG. 15A is a perspective view illustrating the transport paddle 40 located at the retracting position. FIG. 15B is a cross-sectional view of FIG. 15A. FIG. 16A is a perspective view illustrating the transport paddle 40 located at a standby position. FIG. 16B is a cross-sectional view of FIG. 16A. FIG. 17A is a perspective view illustrating the transport paddle 40 located in a transporting position. FIG. 17B is a cross-sectional view of FIG. 17A. FIG. 18A is a view illustrating a state in which the sheet is discharged onto the lower stack tray 137. FIG. 18B is a partially enlarged view of FIG. 18A. FIG. 18C is a view illustrating a state in which the sheet is aligned in the width direction. FIG. 19 is a flow chart illustrating the alignment processing for the sheet discharged onto the lower stack tray 137.

When the unbinding sort mode is set and the image forming job is started (S801), the aligning members 1 of the front alignment unit 220 and the back alignment unit 210 and the transport holder 50 perform initial operation and are moved to the home positions shown in FIGS. 15A and 15B. A description of the alignment processing (S812 to S817) on the processing tray 138 when the binding processing is performed is omitted here.

The home positions in the sliding direction of the aligning members 1, 1 are detected by the front aligning member HP sensor S9 and the back aligning member HP sensor S10 provided respectively on the front side and the back side, and when the aligning members 1, 1 are not located in the home positions, the aligning members 1, 1 are moved. The home positions in the sliding direction of the aligning members 1, 1 mean a state in which the aligning members 1, 1 are located at both ends in the front-back direction. The home position in this embodiment is the retracting position described above.

The home positions in the lifting and lowering directions of the aligning members 1, 1 are detected by the aligning member lifting and lowering HP sensor S11, and when the aligning members 1, 1 are not located at the home positions, the aligning members 1, 1 are moved. The home positions in the lifting and lowering directions of the aligning members 1, 1 are retracting positions where the front ends of the aligning members 1, 1 are rotated upward around the first aligning spindle 2 as a rotation center and retracted.

The home position in the rotational direction of the transport holder 50 is detected by the transport paddle HP sensor S12, and when the transport holder 50 is not located at the home position, the transport holder 50 is rotated. The home position of the transport holder 50 means a state in which the transport holder 50 is stored above the upper opening and closing guide 149 in the finisher 100, and a user does not touch the transport holder 50. The transport holder 50 is provided at a position where the transport holder 50 does not interfere with the opening and closing operation of the upper opening and closing guide 149.

When the aligning members 1, 1 and the transport holder 50 are located at the home positions by the initial operation at the start of the job, the aligning members 1, 1 and the transport holder 50 are then moved to a standby position shown in FIGS. 16A and 16B where the sheet can be received. First, the alignment members 1, 1 are slidably moved according to input sheet size information, and then the alignment members 1 are lowered by a predetermined amount and moved to the standby position (S802). The standby positions of the alignment members 1, 1 are positions where an interval between the aligning members 1, 1 is set to be larger by a predetermined amount than the length in the width direction (front-back direction) of the sheet and the aligning members 1, 1 do not interfere with the sheet discharged from the bundle discharge roller pair 130. Similarly, the transport holder 50 is rotated to be moved from the home position to the standby position (S803). The standby position of the transport holder 50 is a position above the bundle discharge roller pair 130 where the transport holder 50 protrudes from the inside of the finisher body 400 to the outside of the finisher body 400 (above the lower stack tray 137) so that the transport holder 50 is located above the sheet to be discharged.

When a sheet suitably imposed and formed with an image is sequentially discharged from the discharge roller 907 of the copier body 600, the sheet P is delivered to the entrance roller pair 102. The sheet P then passes through the conveyance path 103 and enters the bundle conveyance path 121. Thereafter, the sheet P is conveyed to a lower path 126 by the saddle path switching member 125 to pass from the lower discharge roller pair 128 to the bundle discharge roller pair 130, and, thus, to be conveyed to the lower stack tray 137 (S804). When the rear end of the conveyed sheet P passes through a nip of the bundle discharge roller pair 130 (S805), the transport holder 50 is lowered from the standby position to the transporting position, and the upper surface of the sheet P is pressed toward the stacking surface of the lower stack tray 137. This constitution assists the drop of the sheet P from a position Sit immediately after the passing of the discharged sheet P through the nip of the bundle discharge roller pair 130 to a position S1*b* on the lower stack tray 137 (see, FIG. 17). Namely, the sheet P passing through the nip of the bundle discharge roller pair 130 can be forcibly dropped by moving the transport holder 50 from the standby position to the transporting position, and the drop time can be reduced.

Since the drive source of the bundle discharge roller pair 130 and the drive source of the transport paddle 40 are the same as each other, the transport paddle 40 rotates simultaneously with the bundle discharge roller pair 130, so that the sheet P can be transported to abut (bias) against the abutment portion 170 on the lower stack tray 137. Namely, the alignment processing in the conveyance direction is performed simultaneously with the lowering of the transport holder 50 (S806). The timing of lowering the transport holder 50 after the passing of the sheet rear end through the nip of the bundle discharge roller pair 130 is controlled so that the transport holder 50 is lowered after a lapse of a predetermined time from the passing of the sheet rear end through a lower discharge sensor 129. This timing can be set according to, for example, the size and basis weight of the discharged sheet and sheet information such as presence or absence of image formation.

When the transport holder 50 performs abutting operation at the transporting position (the sheet is transported to abut against the abutment portion 170) and a predetermined time when the abutting operation is completed has elapsed, the transport holder 50 is rotated to move to the standby position again (S807). A period of time when the transport holder 50 is located at the transporting position can be set according to, for example, the size and basis weight of the discharged sheet and sheet information such as presence or absence of image formation.

When the transport holder 50 is rotated to the standby position, as shown in FIG. 18A, after the sheet is dropped onto the lower stack tray 137, the transport holder 50 holds the aligning members 1, 1, which are on standby at a position larger by a predetermined amount (C in FIG. 18B) than the length in the front-back direction of the sheet P, so that the width between the aligning members is the same as the sheet width. Consequently, the state shown in FIG. 18C is obtained (S808). After the completion of the aligning operation in the width direction, the aligning members 1, 1 are lifted to move to the standby positions (receiving positions) again (S809). The above operation is performed for each discharge of a sheet, and after the aligning operation (alignment processing) for a last sheet in the job, the aligning members 1, 1 and the transport holder 50 are moved to the respective standby positions, whereby the job is completed (S810 and S811).

As described above, in the finisher 100 according to this embodiment, the transport holder 50 rotatably supporting the transport paddle 40 is rotatably provided above the bundle discharge roller pair 130. Thus, the drop of the sheet P passing through the nip of the bundle discharge roller pair 130 can be assisted. Consequently, even when a sheet requiring a long time to drop by its own weight, such as thin paper is used, the drop time can be reduced. Moreover, even when thin paper whose dropping posture is unstable is used, the thin paper is dropped while pressed, and therefore, the dropping posture can be stabilized. As a result, in the finisher, the operation timing is not delayed, and the finisher can suitably correspond to an image forming apparatus with high productivity (high processing speed) and thin paper.

After the completion of the alignment processing, the transport holder 50 and the like are moved to the respective retracting positions in the finisher 100. Thus, for example when a user takes out a sheet discharged onto the lower stack tray 137, it is possible to prevent the user from touching the transport holder 50 and the like. Consequently, the sheet P can be easily taken without lowering the sheet taking-out property for the user. Further, during the execution of the staple job, the transport holder 50 is located at the retracting position where the transport holder 50 does not interfere with the opening and closing of the upper opening and closing guide 149. Thus, the transport holder 50 does not interfere with the staple processing.

In this embodiment, the transport holder 50 is rotated to move the transport paddle 40 to the standby position, the abutting position, and the retracting position. Thus, a moving mechanism moving the transport paddle 40 can be simplified. The rotation drive of the transport paddle 40 and the rotation drive of the bundle discharge roller pair 130 are driven from the same drive source, whereby the number of components can be reduced.

By virtue of the use of the transport paddle in which paddles are bonded to the rotation shaft, the rear end position of the sheet can be regulated more suitably.

Second Embodiment

Next, a copier 1000A according to a second embodiment of the present invention will be described with reference to FIGS. 20A to 20C by citing FIGS. 1 and 2. The copier 1000A according to the second embodiment is different from the first embodiment in that the transport holder 50 is rotatably supported by the finisher body 400. Thus, in the second embodiment, the point different from the first embodiment, that is, the transport holder 50 supported by the finisher body 400 will be mainly described. In the second embodiment, the components similar to those of the copier 1000 according to the first embodiment are denoted by the same reference numeral, and the description thereof is omitted. Namely, in the second embodiment, the constitution similar to that of the first embodiment provides the effects similar to those of the first embodiment.

Figure 20A:
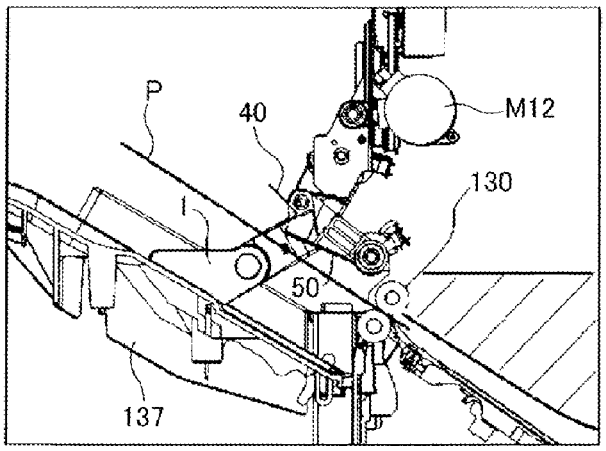
FIG. 20A is a view illustrating a state in which a transport paddle according to a second embodiment is located at a standby position.

FIG. 20A is a view illustrating a state in which a transport paddle 40 according to the second embodiment is located at the standby position. FIG. 20B is a view illustrating the transport paddle 40 moved to the transporting position. FIG. 20C is a view illustrating the transport paddle 40 located at the retracting position.

Figure 20B:
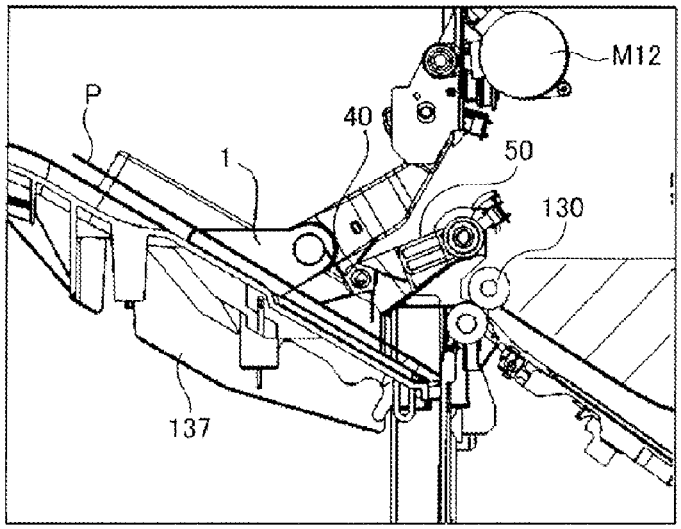
FIG. 20B is a view illustrating the transport paddle moved to a transporting position.
Figure 20C:
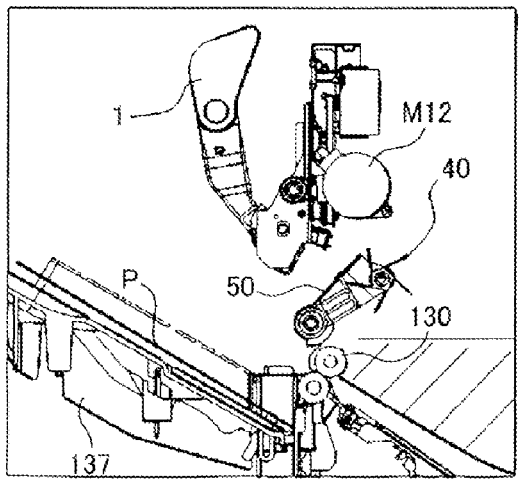
FIG. 20C is a view illustrating the transport paddle located at a retracting position.

As illustrated in FIGS. 20A to 20C, the transport holder 50 according to the second embodiment is rotatably supported by the finisher body 400 so as to be retractable from the inside of the finisher body 400 to outside. Namely, a retracting position of the transport holder 50 is provided in the finisher body 400, and the transport holder 50 is moved from the retracting position to the standby position and the transporting position located outside. Since the conveyance of the sheet P and the alignment processing for the sheet P at the time of the above unbinding processing is similar to those in the first embodiment, a description thereof is omitted here.

As shown in the second embodiment, the transport holder 50 according to this embodiment is not limited to be supported by an upper opening and closing guide 149. The transport holder 50 may be supported by the finisher body 400 as in the second embodiment, and, for example, the transport holder 50 may be supported by a fixing member (not shown) provided in the finisher body 400. Even in the constitution in which the transport holder 50 is supported by the fixing member, the effects similar to those of the first embodiment can be provided.

Hereinabove, although the embodiments of the present invention have been described, this invention is not limited to the above embodiments. The effects described in the embodiments of the present invention are merely a list of the most suitable effects generated from the present invention, and the effects of the present invention are not limited to those described in the embodiments of the present invention.

For example, in the present embodiment, although the transport holder 50 rotatably supported by the upper opening and closing guide 149 is used, this invention is not limited to this. For example, the transport holder 50 slides from the retracting position in the finisher body 400 to be appeared at the standby position, and the transport holder 50 may be lifted or lowered from the standby position and moved to the transporting position. Namely, the transport holder 50 may be moved to the first, second, and third positions by configurations other than rotation.

In this embodiment, although the transport paddle has been described as the transport member (rotating member), this invention is not limited thereto. The transport member may be one as long as the sheet can be transported to abut against the abutment portion 170, and a rotation roller, for example, may be used as the rotating member.

In this embodiment, although the pair of transport paddles arranged coaxially symmetrically is used, this invention is not limited to this constitution, and one or a plurality of transport paddles may be provided. When a plurality of transport paddles is arranged symmetrically, the transport paddles can be transported straight toward the abutment portion, for example.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-167587, filed Jul. 29, 2011, which is hereby incorporated by reference herein in its entirety.

What is claimed is:

1. A sheet stacking apparatus configured to perform an alignment process of a sheet conveyed from an image forming apparatus, the sheet stacking apparatus comprising:

a discharge portion which discharges a sheet;

a stacking portion on which the sheet discharged from the discharge portion is stacked;

an abutment portion against which an upstream end in a discharge direction of the sheet discharged on the stacking portion is abutted;

a transport member, provided above the discharge portion, which moves to a first position where the transport member is on standby, a second position where the transport member transports the sheet discharged on the stacking portion to abut against the abutment portion so as to perform the alignment process, and a third position where the transport member retracts in the apparatus body;

a moving portion which moves the transport member; and a control portion which controls the moving portion so that the transport member is on standby at the first position at the start of an image forming job, the transport member moves between the first position and the second position for each discharge of the sheet by the discharge portion, and the transport member moves to the third position after termination of the alignment processing for a last sheet of the image forming job.

2. The sheet stacking apparatus according to claim 1, further comprising a rotating lever, provided rotatably on the apparatus body, which supports the transport member at a front end, wherein the control portion controls the moving portion so that the transport member moves to the first, second, and third positions by the rotation of the rotating lever.

3. The sheet stacking apparatus according to claim 1, further comprising:

a processing stacking portion, provided upstream in the discharge direction of the discharge portion, which stacks the sheet on which predetermined processing is to be performed; and a supporting member, provided above the processing stacking portion, which rotatably supports one of a pair of rollers constituting the discharge portion, wherein the one roller is separated from the other with the upper movement of the supporting member, and the transport member is supported by the supporting member, and is moved with the movement of the supporting member.

4. The sheet stacking apparatus according to claim 3, further comprising a rotating lever, provided rotatably on the supporting member, which supports the transport member at a front end, wherein the control portion controls the moving portion so that the transport member moves to the first, second, and third positions by the rotation of the rotating lever.

5. The sheet stacking apparatus according to claim 1, wherein after the upstream end in the discharge direction of the sheet passes through the discharge portion, the control portion controls the moving portion so that the transport member moves from the first position toward the second position to press an upper surface of the sheet toward the stacking portion.

6. The sheet stacking apparatus according to claim 1, wherein the transport member is a rotating member having a plurality of paddles radially bonded to a rotation shaft, and the rotating member is rotated to transport and abut the sheet against the abutment portion.

7. The sheet stacking apparatus according to claim 1, further comprising a width direction aligning portion which moves in a width direction perpendicular to a discharge direction of the sheet discharged from the discharge portion and aligns the sheet, stacked in the stacking portion, in the width direction.

8. An image forming apparatus comprising:

an image forming portion which forms an image on a sheet;

a discharge portion which discharges a sheet on which the image is formed;

a stacking portion on which the sheet discharged from the discharge portion is stacked;

an abutment portion against which an upstream end in a discharge direction of the sheet discharged on the stacking portion is abutted;

an transport member, provided above the discharge portion, which moves to a first position where the transport member is on standby, a second position where the transport member transports the sheet discharged on the stacking portion to abut against the abutment portion, and a third position where the transport member retracts in the apparatus body;

a moving portion which moves the transport member; and a control portion which controls the moving portion so that the transport member is on standby at the first position at the start of an image forming job, so that the transport member moves between the first position and the second position for each discharge of the sheet by the discharge portion, and so that the transport member moves to the third position after termination of the alignment processing for a last sheet of the image forming job.

9. The image forming apparatus according to claim 8, further comprising a rotating lever, provided rotatably on the apparatus body, which supports the transport member at a front end, wherein the control portion controls the moving portion so that the transport member moves to the first, second, and third positions by the rotation of the rotating lever.

10. The image forming apparatus according to claim 8, further comprising:

a processing stacking portion, provided upstream in the discharge direction of the discharge portion, which stacks the sheet on which predetermined processing is to be performed; and a supporting member, provided above the processing stacking portion, which rotatably supports one of a pair of rollers constituting the discharge portion, wherein the one roller is separated from the other with the upper movement of the supporting member, and the transport member is supported by the supporting member, and is moved with the movement of the supporting member.

11. The image forming apparatus according to claim 10, further comprising a rotating lever, provided rotatably on the supporting member, which supports the transport member at a front end, wherein the control portion controls the moving portion so that the transport member moves to the first, second, and third positions by the rotation of the rotating lever.

12. The image forming apparatus according to claim 8, wherein after the upstream end in the discharge direction of the sheet passes through the discharge portion, the control portion controls the moving portion so that the transport member moves from the first position toward the second position to press an upper surface of the sheet toward the stacking portion.

13. The image forming apparatus according to claim 8, wherein the transport member is a rotating member having a plurality of paddles radially bonded to a rotation shaft, and the rotating member is rotated to bias and abut the sheet against the abutment portion.

14. The image forming apparatus according to claim 8, further comprising a width direction aligning portion which moves in a width direction perpendicular to a discharge direction of the sheet discharged from the discharge portion and aligns the sheet, stacked in the stacking portion, in the width direction.

15. A sheet stacking apparatus comprising:

a discharge portion which discharges a sheet;

a stacking surface on which the sheet discharged from the discharge portion is stacked;

an abutment portion against which an end of the sheet discharged on the stacking surface is abutted;

a transport portion which transports the sheet on the stacking surface, the transport portion moving to a first position where the transport portion is on standby, a second position where the transport portion transports the sheet discharged on the stacking surface to abut against the abutment portion, and a third position where the transport portion is away from the stacking surface further than the second position; and a control portion which controls a movement of the transport portion so that the transport portion moves from the first position to the second position in response to a sheet discharging operation of the discharge portion while a plurality of sheets are continuously discharged on the stacking surface, and the transport portion moves to the third position after the transport portion transports a last sheet of the plurality of sheets discharged on the stacking surface to abut against the abutment portion.

16. The sheet stacking apparatus according to claim 15, further comprising a rotating lever, provided rotatably, which supports the transport portion at a front end, wherein the control portion controls the movement of the transport portion so that the transport portion moves to the first, second, and third positions by the rotation of the rotating lever.

17. The sheet stacking apparatus according to claim 15, further comprising:

a processing stacking portion, provided upstream in the discharge direction of the discharge portion, which stacks the sheet on which predetermined processing is to be performed; and a supporting member, provided above the processing stacking portion, which rotatably supports one of a pair of rollers constituting the discharge portion, wherein the one roller is separated from the other with the upper movement of the supporting member, and the transport portion is supported by the supporting member, and is moved with the movement of the supporting member.

18. The sheet stacking apparatus according to claim 17, further comprising a rotating lever, provided rotatably on the supporting member, which supports the transport portion at a front end, wherein the control portion controls the movement of the transport portion so that the transport portion moves to the first, second, and third positions by the rotation of the rotating lever.

19. The sheet stacking apparatus according to claim 15, wherein after the upstream end in the discharge direction of the sheet passes through the discharge portion, the control portion controls the movement of the transport portion so that the transport portion moves from the first position toward the second position to press an upper surface of the sheet toward the stacking portion.

20. The sheet stacking apparatus according to claim 15, wherein the transport portion is a rotating member having a plurality of paddles radially bonded to a rotation shaft, and the rotating member is rotated to transport and abut the sheet against the abutment portion.

21. The sheet stacking apparatus according to claim 15, further comprising a width direction aligning portion which moves in a width direction perpendicular to a discharge direction of the sheet discharged from the discharge portion and aligns the sheet, stacked in the stacking portion, in the width direction.

* * * * *